US010828553B2

(12) United States Patent
Ramirez

(10) Patent No.: US 10,828,553 B2
(45) Date of Patent: Nov. 10, 2020

(54) OPEN PALM HAND COVERS AND USES OF SAID COVERS

(71) Applicant: John C. Ramirez, Redlands, CA (US)

(72) Inventor: John C. Ramirez, Redlands, CA (US)

( * ) Notice: Subject to any disclaimer, the term of this patent is extended or adjusted under 35 U.S.C. 154(b) by 90 days.

(21) Appl. No.: 15/990,776

(22) Filed: May 28, 2018

(65) Prior Publication Data

US 2018/0272225 A1 Sep. 27, 2018

Related U.S. Application Data

(63) Continuation-in-part of application No. 14/544,887, filed on Mar. 3, 2015, now Pat. No. 10,016,671, which is a continuation of application No. 13/374,868, filed on Jan. 20, 2012, now abandoned.

(51) Int. Cl.

| | |
|---|---|
| ***A41D 19/00*** | (2006.01) |
| ***A41D 19/015*** | (2006.01) |
| ***A63B 71/14*** | (2006.01) |

(52) U.S. Cl.

CPC ..... *A63B 71/141* (2013.01); *A41D 19/0013* (2013.01); *A41D 19/0017* (2013.01); *A41D 19/01547* (2013.01); *A41D 2600/10* (2013.01); *A63B 2243/007* (2013.01); *A63B 2243/0037* (2013.01)

(58) Field of Classification Search

CPC ..... A41D 9/0017; A41D 19/01547; A41D 2600/10; A63B 2243/0037; A63B 2243/007

USPC ..... 2/161.1–0.6, 160; 473/448, 450, 472

See application file for complete search history.

(56) References Cited

U.S. PATENT DOCUMENTS

| | | | | |
|---|---|---|---|---|
| 2,702,906 A * | 3/1955 | Causse | ..... | A41D 19/01547 2/159 |
| 5,500,956 A * | 3/1996 | Schulkin | ..... | A63B 71/148 2/159 |
| 2007/0118966 A1* | 5/2007 | Beraznik | ..... | A41D 19/01547 2/159 |

* cited by examiner

*Primary Examiner* — Katherine M Moran

(57) ABSTRACT

According to the various features characteristics and embodiments of the present invention which will become apparent as the description thereof proceeds, the present invention provides partial hand covers and the use of said covers, intended to increase the overall performance in sports activities. More specifically, the present invention offers strategic openings in select areas of the palm, creating substantial and significant advantages for the user, in playing the sports of football, golf and basketball.

16 Claims, 15 Drawing Sheets

OPEN PALM HAND COVERS AND USES OF SAID COVERS

This application is a Continuation-In-Part to application Ser. No. 14/544,887, which is a Continuation to application Ser. No. 13/374,868, filed on Jun. 20, 2012, in its entirety, which is a Continuation-In-Part to application Ser. No. 12/322,060, now abandoned.

FIELD OF THE INVENTION

The present invention relates to sports apparatus and equipment, and uses thereof, used in playing the game of various sports. The present invention and its multi-sport embodiments enhance the overall performance in athletic tasks and/or execution during sports play, including practice by creating gloves that will allow football players, golfers and basketball players better perform hand tasks.

BACKGROUND OF THE INVENTION

An important goal in playing sports is to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been created for different sports. Even within a sport, different types of gloves have been invented to, among other things, maximize performance in specific tasks.

In football, for example, there are gloves that users playing the position of offensive and defensive Tackles can wear, that have thick padding around part of the hand. Offensive Receivers can purchase more expensive, all closed-finger, thin gloves to enhance their ability to catch and grip a football.

The use of gloves in football is so widespread that nearly every football player uses them, with the notable exception of football Quarterbacks. You rarely see a quarterback wear gloves, even if just to keep warm. Most quarterbacks choose to play football without gloves. This is largely because prior art consists of generic full-fingered, covered palm gloves which are uncomfortable and burdensome on a quarterback's dominant (throwing) hand, particularly on those fingers a quarterback places over the football laces. In addition, these covered gloves prevent a quarterback to have any 'feel' of the ball because the gloves cover the fingers as well as all of the palm area thereby desensitizing the entire hand from having much feeling of the football.

Playing the position of quarterback without the help of gloves, however, can also be an inferior choice. The website Wikihow.com, provides a good description of the conventional way to hold and throw a football. "Throwing the football is simple. Put your non-throwing side foot in front of you. Have your Pinkie, Ring and Middle fingers around the laces with your Index [Forefinger] finger on the strap. Put the other hand up on the ball. Put the ball up by your ear. Twist your hips toward the front foot. Throw the ball at the receiver." Whereas, the fingers over the laces have a solid grip on the ball—primarily due to the football laces on the ball—the two fingers off the laces (forefinger and thumb) are virtually unsupported and therefore have a relatively weaker grip, creating a weak overall grip on the football.

This weak overall grip becomes more pronounced when added stress is placed on the thumb or forefinger.

When a quarterback, intending to pass the football, for example, suddenly has to scramble, or if the quarterback 'pumps' the ball (goes through all the motions and speed of throwing the ball but doesn't actually release the ball), the grip strength of the thumb and forefinger can determine whether or not a quarterback fumbles the ball. On a wet football field, during extreme weather conditions (hot or cold), that weaker or looser grip makes for a much more difficult completed pass, less success at throwing a spiral, and generally increased inconsistency and inaccuracy in passing.

This need to feel a ball with one's hand has therefore resulted in quarterbacks having a difficult choice. Although clearly these players would benefit from added grip enhancements on the throwing hand, prior art in the form of covered palm gloves force a quarterback to choose between all feel and no feel. Virtually all quarterbacks have chosen to maintain feel and sacrifice the ability to better grip the football, and therefore not wear gloves. It is no surprise that quarterback fumbles remain a significant problem in football, even at the highest performance levels. In the 2010 season, for example, the individuals with the most fumbles in the NFC and AFC were both quarterbacks, each with 11 fumbles a piece (David Garrard and Michael Vick). Clearly, there remains an insoluble problem in the sport for amateurs and professional quarterbacks.

Under the 'tips' section of Wikihow.com, it further describes proper football throwing form: "A proper throw will feel like it's only utilizing the Thumb, Index [Forefinger], and Middle finger. Good release will 'roll' off of your Index and Middle finger, to impart more spin; you may snap your wrist through as you follow through to the hip. The other three fingers on your hand stabilize the ball as its being flung. They should not be used to impart spin on the ball. The most important finger to throwing a spiral is the Index finger; it is the finger that holds the most leverage in putting spin on the ball." There clearly is a need for new art that could offer the ability to increase a quarterbacks grip in key areas, such as along the fingers, while being able to provide some ability to still feel the ball with the skin of the throwing hand, such as, for example, leaving select areas of the palm uncovered.

To conclude, new art is required for individuals who play football quarterback that can offer a more stabilizing overall grip of a football, by conveying grip enhancers to select areas of the hand. This new art will decrease fumbles and other turnovers, while increasing throw accuracy. Because no such art exists, it is no surprise that there were a total of 731 fumbles in the 2010 NFL season, and the highest quarterback completion rating was less than 70 percent (Official Stat Book of the NFL, 2011). Given the fact that fumbles persist at the professional level and therefore certainly at the collegiate and amateur levels, one can see that past attempts to solve these problems have had limited success. Inventing a solution to increase grip and overall ball control for football quarterbacks by creating a structurally superior glove would give quarterbacks many of the benefits that gloves have provided for users playing the other football positions as well.

In the of sport Golf, to be sure, there exists much prior art in the form of gloves for a golfer's weak (non-dominant) hand. In fact most active golf players wear a glove on their weak hand, and go without a glove for their strong hand (if one were to go to any major store to buy golf gloves, they would be sold and packaged in singles—one glove—not sold in pairs). Gloves are prevalent in golf largely because of the important role that hand grip and control play in a golfer's overall performance.

Although there exist many types gloves for a golfer's weak-hand, they all attempt to maximize a golfer's weak-hand grip without regard to a golfer's weak-hand feel, and hand coordination needs. It is no surprise, therefore, that prior art consists of full-fingered (all fingers are covered), closed palm (entire palm is covered) gloves. As a result, a typical golfer must rely on his/her weak-hand to provide all of the enhanced grip support, and on his strong-hand to provide all of the 'feel' in his golf swing. There is, therefore, an opportunity to invent a device—and significantly improve prior art—that could offer some 'feel' ability for the weak-hand, without significantly diminishing that enhanced grip ability that hand covers offer. This new ability to be able to feel the club with both hands—and therefore throughout the entire grip—would increase overall hand control as well as hand coordination of a golfer's club swing, and therefore greater success in competition.

The golf grip and hand coordination are, of course very important in successful play execution. In a popular 1989 video titled "Golf for Juniors" by Billy Casper, a golf instructor states "with over 50 years golf experience the two points that we stress are, one, the grip. I firmly believe that the grip is the most important fundamental because it's the only contact that the body has with the golf club and the golf ball." Coordination is a key aspect and could be enhanced by properly feeling the golf club throughout the entire golf swing.

New art would therefore significantly and substantially enhance golf performance by providing the ability to feel throughout the club grip, for a more stable feel, and also allow a golfer to better feel if one part of the club moves while the other side does not. For example, although prior art golf gloves offer grip capabilities on the fingers of the golfer, it also covers the palm area which therefore desensitizes the palm in feeling of any movement of the golf club during the swing. By offering a partially open-palm glove, for example, one could use it (the new art glove) to better feel if even a slight movement has taken place of the golf club during a golf swing, which of course would indicate improper golf swing mechanics. More specifically, best grip points are around the thumb and forefingers of both hands. The weakest area of grip is along the edge of the weak hand. The problem is compounded because prior art completely covers the edges and entire palm of the weak hand, minimizing the ability to have much feel in that area, and therefore making it very difficult to notice if there was any movement during the downswing of the golf swing.

In Golf magazine's April 2005 article titled "Fix your grip. The wrong grip can cripple your swing—Here's the cure", golf instructor Charlie King provides an overview of how to grip a golf club. "Good golf starts with your grip. The proper hold on the club helps you do three crucial things: Hinge your wrists, control the clubface at impact and support the club throughout the swing. Here are three simple grip tips." As King continues, his third tip is "both hands; solid at the top. An effective grip sets the face square at the top, with the shaft parallel to the target line. You should feel most of the club's weight in your left Thumb and right Forefinger. Now you're ready to turn it loose." At this point one begins to swing the golf club, and before impact with the golf ball, one unhinges the wrist as well, which can result in a slight movement of the golf club grip. A simple test can more easily reveal this potential problem. Constant swinging of a golf club at real swing speeds, for example, often results in soreness along the head of the palm, especially around the edge by the pinkie finger. This soreness can often also come from the rubbing or slipping, between the club handle and the weak-hand grip, especially during the unhinging process, suggesting a need to find a way to increase the grip of a golfer's weak hand. This is especially important in the sport of golf because even the smallest of slipping—during the golf swing or upon impact of the golf ball—can create enormous inconsistencies and inaccuracies, critical issues in determining overall performance. Therefore, a significant 'feel' problem and opportunity currently exists to create a glove that could offer a golfer the ability to maintain the necessary feel of a golf club, by say offering a glove that is uncovered in select areas of the palm, where the club handle would normally touch the skin of the palm, while leaving other areas of the glove covered and increasing the grip capabilities of the weak-hand. Creating a solution to the problem will provide a significantly better overall grip and overall feel, naturally resulting in a more productive performance in golf by, among other things, decreasing inconsistencies and inaccuracies, critical issues in determining overall performance.

Whereas weak-hand support products seem to be crowded in the sport of Golf for the full golf swing, there is a long existing need for a device that could offer added support for a golfer's putting needs without significantly diminishing its ability to adequately feel the golf club. Inventing a solution to this problem could, among other things, allow for greater golf swing control and consistency, and create an entirely new market because this new device would support a golfer's putting needs.

Virtually no one uses a glove when putting. In fact, most that use a glove when playing golf, all take the glove off as they prepare to putt. Most have to take the glove off to putt because the need to have a strong grip is superseded by the critical need to feel the club. To putt then, one must take off one's glove all 18 times (when playing on a standard 18 hole golf course), which of course is time consuming, burdensome, distracting to the task at hand. Inventing a glove that could be used throughout the golf course, for general golf swing as well as for putting, could solve this problem and provide several benefits.

Consequently, there are clear indications that an entirely new market exists for a device that could support a golfer's putting needs. In particular there remains an unrecognized problem and an unmet need that would provide multiple benefits, such as better overall grip, more coordination with both hands, as well as some protection from any constant grip slipping, during the practice or play of golf, and in various other sports activities.

In general, opportunities exist to solve several issues in golf. In general golf swing as well as in putting and therefore creating new methods by offering gloves with strategically placed recesses.

In particular there remains an unmet need to offer a glove that could allow a golf user to have increased feel in his weak hand while maintaining the heightened grip capabilities that a glove generally provides. This problem if solved, would provide multiple benefits, such as better overall grip, more coordination with both hands, more feel throughout the golf grip not just from one hand, as well as some protection from any constant grip slipping, during the practice or play of golf, and in various other sports activities.

In the sport of Basketball, there is a significant void when it comes to grip enhancers that one can use to enhance performance, or even simply for aesthetic purposes, and/or that may be used during actual game play. Although there are several generic multisport gloves in the market today, virtually none of the over 100 million basketball players use gloves when playing basketball. A primary reason why basketball players choose not to use gloves is that basketball players often need to be able to simultaneously both grip and feel the basketball. Although many hand tasks require a good grip, no art currently exists that would adequately provide these players with enhanced grip capabilities, or enhanced protection, without having to sacrifice the critical ability of being able to properly feel the basketball as well.

One clear hand task in basketball requiring this grip and feel combination is in shooting the basketball with the intention of making a score or basket. Conventional jump-shot shooting form requires, among other things, that the player hold the basketball largely with the fingertips of both hands, and creating a small opening between the ball and the palm area of the player's strong-hand. This, in turn, requires that a portion of the palm area—hereinafter called a shooter's gap—remain untouched by the basketball. This shooters gap is especially important when properly shooting free throws as well.

There are several figures from those skilled in the art of basketball which show the same areas where the basketball is supposed to touch the hand. For example, the website dicksbasketballcamp.com, highlights the areas as primarily the fingertips, the top of the palm area, and part of the thumb bulge. The book Play Better Basketball also has essentially the same drawing (page 81). The shooter's gap region would represent much of the area that should not be touched by the hand. The boundaries would represent the middle of the palm, generally following the edges of the thumb bulge down to the wrist crease. Additionally, the east portion would represent part, though not more than 50 percent of the Hypothenar Eminance. The top of the shooters gap would begin below the base of the fingers (not the thumb), generally about 0.70-0.90 of an inch below the palmar digital crease (at about the Sup. Trans. Palmar ligament). The widest length of the shooters gap is about 2 inches and the widest width is about 2 inches.

No prior art exists that would increase the gripping abilities of a players fingertips while leaving the rest of the hand—especially the shooters gap—uncovered and thus free to feel if the basketball is touching the palm area (indications that would mean that the player is improperly shooting the basketball). Basketball players need to both grip and feel, especially if she misses a shot and needs to adjust accordingly. This need to feel is so important in shooting a basketball that virtually everyone chooses not to wear gloves and instead deal with a lesser control of the basketball, primarily because everyone on the basketball court has to be prepared to shoot the basketball.

In the book, Play Better Basketball (1982), Jim Pruitt discusses proper shooting form. "Here are some of the basic things to check for proper form: Are you elevating the ball, i.e., shooting from your forehead and not from the chest, is the ball centered so your arms form a triangle, are you shooting the ball off the heels of your hand and not burying it in your palms or using just the fingertips . . . ."

Prior art offers limited assistance in maintaining or learning to maintain this shooter's gap. For example there is the SHOTLOCK product that one places on ones hand, that looks and feels like brass knuckles, and is supposed to keep the basketball from touch the center of the palm by physically keeping the ball elevated and away from the palm center. This has major limitations, of course. First, one cannot really use this product during actual game. Second, the device hinders the development in properly developing muscles in the fingers to support elevated ball when not using the device.

Although offering some advantages using prior art, in the form of more generic multisport gloves, these gloves also create major disadvantages that often forces an individual to choose not to use any grip enhancing devices at all because they are not structurally useful. First, most gloves cover the entire palm area, making it impossible to be practically beneficial in the sport of basketball. Second, the prior art gloves that offer openings on the palm area also having significant disadvantages to the point that they too are not used by the millions of individuals playing the sport. By leaving the palm area open much wider than the shooters gap, for example, significantly diminishes the usefulness and can actually distract a player. Some areas of the palm in fact should touch the ball, such as the portion of the palm, and much of the Thumb bulge. Basketball gloves should therefore leave these areas covered so that one could increase the grip and control capabilities in these areas, not have these areas uncovered. There are also other grip products on the market which keep the palm off the basketball. The main problem is that some of these products also keep the player's shooting pads below his fingers off the ball. Most of these devices therefore teach a player an incorrect gripping procedure.

Limited prior art exists that would provide an athlete with the ability to have enhanced control when dribbling a basketball. Proper dribbling form is to rarely, if ever, look at the ball while dribbling said ball—thus one of the critical reasons why one needs to be able to maintain high 'feel' ability. Without any extra grip enhancers however, it is difficult to maintain stable control of the basketball. Minimizing turnovers by offering better ball control while dribbling a basketball would dramatically enhance a player's performance. Those players playing the position of Guard may benefit from added grip support especially because they may need to dribble, at least briefly, with their strong hand as well as with their weak hand. Whereas many players would benefit from control enhancers for their strong (dominant) hand, most guards would certainly also benefit from control enhancers for their weak hand.

According to Wikipedia, 'dribbling is the act of bouncing the ball continuously with one hand, and is a requirement for a player to take steps with the ball. To dribble, a player pushes the ball down towards the ground with the fingertips rather than patting the ball. This ensures greater control.' Feel is critical if one is to try and not look at the ball while dribbling, and instead looking down the basketball court for opportunities to score. Individuals who play basketball also have to both 'feel' and grip a ball to perform properly, and although they too could significantly enhance performance in controlling a ball, prior art forces them to choose all feel as well, and go without any type of grip enhancers. This insoluble problem therefore also exists in dribbling and controlling a basketball, and these players would substantially benefit from developing a way to maintain 'feel' while increasing grip capabilities in select areas of the hand. More specifically, new art is needed that could offer enhancers in certain locations of the hand while leaving key areas of the palm uncovered and therefore being able to maintain necessary feel.

Although athletes playing the position of Forward or Center would also benefit by enhanced dribbling abilities, many of the turnovers caused by Forwards and Centers are often the result of dropping passes thrown to them, or from making a bad pass. Offering art that would enhance the ability to better pass or catch a basketball could therefore also enhance overall performance for anyone playing the sport of basketball. For example, there are some problems associated with wet or oily hands that could be solved with new art in the form of a more structurally specific basketball glove. You often see players wearing cotton wrist bands to keep their hands dry. A typical game—even a professional game—often can have many turnovers. For example, the Los Angeles Lakers, in a 2011 New Year's Eve game against the Denver Nuggets had 20 turnovers alone, so offering art that could increase ball control while shooting, dribbling, passing or even catching a basketball could significantly enhance performance by, among other things, minimizing turnovers. The current solution is to either use these wrist bands or using powder on hands before a game starts.

Clearly, there is significant and substantial need in inventing new art in the sport of basketball. New art could go a long way in offering a player the following benefits, and more:

Better shooting,
Better dribbling
Better catching.
Increased control
Minimizing turnovers
Greater play execution

DETAIL DESCRIPTIONS OF THE INVENTION

In general, the present invention can generally be used in conjunction with any type of sports play or practice.

The present invention has chiefly to do with the palm of the glove. It concerns a particularly located cutout portion of the palm area, making embodiments uniquely useful for individuals playing the sports of football, golf and/or basketball. This one open palm opening may, of course be of different shapes, dimensions and locations in accordance with the scope of the claims of the present invention.

One sport where said present invention will clearly enhance performance is in the sport of football. For example, one particular unmet need that this present invention will satisfy will be with football quarterbacks. In the book "Coaching Football Successfully," by Allan Trinlde (2001), "Quarterback mechanics and ball-handling skills are vital for offensive success and consistency." One embodiment of the present invention comprises of a glove where the top part of the palm area is uncovered. The opening could begin, for example, at or just below the palmar digital crease of the four fingers (not the Thumb), and extend down to about where the third finger joint and the metacarpals connect. The length could therefore range from one to three inches.

Additionally, the glove covers all of the thumb and forefinger, and none of the remaining fingers. This will allow a quarterback to increase his ball grip and overall control of a football while allowing some palm and finger feel of the football as well. The palm opening especially allows some vital hand feel on the throwing hand while the football rests on that part of the palm (or palm opening), and thereby increasing his ball grip and overall control of the football. The palm opening would exist along the top part of the palm area, along the area where the fingers (not the Thumb) connect with the palm area. The opening dimensions could range from about 1 inch to about 2.5 inches in length, and about 0.25 inch to 1.5 inch in width. These embodiments could be made of a natural rubber, having PVC dots throughout. Providing such a physically superior structure by open palm open in this particular location now would a quarterback to use gloves.

Furthermore, this glove could allow a quarterback to take into account the benefits of the laces on a football and give a quarterback the unique ability to grasp a football over the football laces with the comfort and feel of not having a glove by leaving ring finger and pinkie finger of the user's hand completely uncovered and thereby maintaining heightened tactile sensitivities, while adding the support that a glove provides over the thumb and forefinger by having these fingers completely covered. Improvement in throwing accuracy and overall performance would result from this unique type of support provided by the new art. Among the specific benefits of this embodiments include greater success in pass performance. Given that there were a total of 17,269 pass attempts in the 2010 NFL season, the present invention would certainly significantly impact the sport of football.

Providing the palm-opening on this specific area of the palm—only where the ball normally rests on the palm, would allow the quarterback to maintain maximum feel of the football when preparing to throw the ball.

The website USAfootball.com describes the fundamentals of gripping a football and how part of the palm area should feel the football. "1. Place your index or pointer finger near the tip of the ball off the laces and across the seam of the ball. 2. Place your middle and third finger across the laces with the fingertips of these two fingers on the surface of the ball. 3. Place your little finger on the laces of the ball—it should just reach. 4. Make sure you feel pressure between the ball and your passing hand just behind the center point on the back of the ball."

Additionally, quarterbacks also have to run with the ball as well, and this option is starting to grow in acceptance. Clearly, running backs by definition, are the ones who most often run with the ball, but aren't by any means the only ones who run with the ball. The NFL records for most rushing attempts in a season range from 407 (James Wilder, 1984) to 416 (Larry Johnson, 2006). With that said, rushing attempts by a quarterback can certainly be significant, ranging from 118 (Randall Cunningham, 1990) to 123 (Michael Vick, 2006). Few would dispute the fact that gloves have played a major role in helping running back maintain control of the football while running. Clearly the same benefit would be felt by quarterbacks. Therefore, this palm opening embodiment may be bounded, for example, by the palmar digital crease of the pinkie finger, the ring finger and the middle fingers at the top (or North), and by the Sup. Trans. Palmar Ligament on the bottom (or south end), thus leaving the rest of the palm portion including the portion of the palm under the forefinger, covered by the glove. All the fingers of this glove could be covered, and the quarterback would depend on palm opening to provide adequate feel of the football.

Because football is often played outside, embodiments might be made of moisture-resistant fibers and comprise full-fingered gloves as well. The benefits to the user of these embodiments would include: better overall grip and better control in holding and throwing a football, higher throwing accuracy, and less fumbles. These embodiments would give a quarterback the unique ability to grasp a football by adding the support that a glove provides, over all five fingers, with the comfort and feel of not having a glove and providing the ability of maintain heightened feel along a key area of the palm. No prior art offers this unique type of superior support and ability.

Other similar embodiments could also increase grip capability on all five fingers, while leaving part of the hand uncovered and able to maintain the necessary 'feel' of the ball. The palm opening in these embodiments could begin and follow along the entire palmar digital crease of the four fingers (not the thumb) and extend down the palm about 1.5 inches. The uniquely placed palm opening will also give the quarterback immediate feedback as to where the football laces are or where the position of the ball is right from the moment he receives the ball from the Center. This will allow the quarterback to properly reposition the ball to throw or to hand off to a teammate. The benefits would also result is a stronger overall grip making for a much higher success at throwing a spiral, generally higher consistency ball handling and performance in play execution.

In addition to offering greater throwing accuracy and consistency, these and other embodiments would also help minimize quarterback fumbles by adding support when 'pumping' the ball, scrambling from being tackled, and when catching and throwing the football when in 'shot gun' formation (when in shot gun formation especially, a quarterback must quickly look down field at his receivers and 'feel' for the football laces). The present invention would allow a quarterback to maintain a heightened sense of feel by the opening in the palm area while increasing the grip support on other areas of the hand, such as on his Thumb, Forefinger and Middle Finger. The features will, among other things, now solve the problem of needing to both grip and feel with the throwing hand, and therefore allow quarterbacks to use gloves, much like football players in all other football positions, thereby enhancing grip and control while maintaining or even enhancing overall feel.

Generic multisport palmless gloves have not been used by quarterback for several reasons. A much larger opening then identified by the present invention would bring inferior results. For example, if the palm area was entire uncovered, it would be much easier to get residue inside the glove and therefore result in significant discomfort. It is therefore, this more narrowly defined palm opening, substantially the area of the palm that generally touches the football, that offers superior results by it uniquely positioned palm opening while leaving the rest of the user's palm covered by the glove.

If one were to compare the features that this invention offers to those of prior art, such as Eyman or Mosley, one would immediately see the significant and substantial differences. The present invention provides an immediate feedback mechanism as to the position of the football, and does not need to look down to find the football laces. This is done, of course by concentrating the opening around the area where a quarterback generally touches. Significantly increasing this opening could actually disrupt quarterback function. For example, when a quarterback receives the football and prepares to make a pass, he usually has to spin the football in his hands to try and quickly find the football laces, by feeling the ball. A significantly large palm opening, such as those by Eyman and Mosley could actually snag the football laces on the opening which, of course could spell disaster in play execution.

In the 2010 NFL season, Drew Brees made over 600 pass attempts. Embodiments now offer a new method of playing the position of quarterback, which could make an immediate impact on the sport, particularly when it comes to passing the football. A quarterback places a preferred embodiment on his throwing hand. He then receives the football from the Center and, without looking at the ball, uses the open palm area to help reposition the football such that it could be thrown. The quarterback, now with a stronger grip because of the glove, can more accurately throw the football at his intended target, and thereby solving prior inoperability in the use of gloves by most quarterbacks.

In general, embodiments of the present invention can generally be used in conjunction with any type of quarterback related activity or sports play. As discussed, they offer an individual with the opportunity to increase overall arm task performance. Maintaining or increasing overall control, for example, can provide many benefits to a user of these, and other embodiments. Among the many benefits of the arm task enhance embodiments are they:

Allow an individual to maintain or increase control of a ball

Provide the unique solution for players who desire better grip capabilities in select areas Provide a player with the ability to convey grip ability that can more evenly extend out further than just the bare hand (by wearing a glove)

Offer a more stabilizing overall grip of a ball or object, by conveying grip enhancers to select locations of the hand.

Additionally, these embodiments can provide:

Improved performance in arm task execution

Improve overall grip

Improve stability of overall grip throughout the grip of a ball

More control

More consistency in play execution

Less ball mishandles

Solves a previously insoluble problem and thereby now allowing quarterbacks to now use gloves Provides more accurate work—throwing. Should result in better throwing percentages, lesser fumbles, better hand-offs.

Less turnovers while a quarterback runs with the football

Increased grip while maintaining feel so don't need to look at ball

Another sport where the present invention will meet an unmet need is in the sport of Golf. First, some embodiments would improve prior art because of its physical difference and function utility. Currently, only full-fingered gloves exist for golfers, regardless of one's preferred golf grip. Prior art therefore does not allow a golfer to take complete advantage of his/her preferred grip, which is often selected to create a strong complete coordinated swing with both hands.

One very popular grip, for example, is called the interlocking grip. When you use this grip, the Forefinger of the golfer's weak-hand is placed over his strong-hand. With this grip, clearly the role of the weak-hand's Forefinger has less to do with grip and more with coordination and feel on the strong-hand, to more effectively control the golf swing and to provide greater golf swing consistency. There is, therefore, no real need to cover the weak-hand's Forefinger, and covering the Forefinger actually diminishes said Forefinger's sensitivities. Additionally, the club feeling is also diminished throughout and along the palm area of the weak hand, forcing the strong hand to have to provide all the feel in coordinating a successful swing.

Embodiments of the present invention would offer significant improvement to prior art. One embodiment that would, among other things, improve prior art would comprise a glove that covers essentially of the weak-hands Thumb, Middle, Ring and Pinkie Fingers, while leaving the Forefinger completely uncovered. Additionally, the palm area, where the club crosses on the weak hand, would also be uncovered. Although golfer's who use the "overlapping" golf grip might also find the above mentioned very useful, another embodiment might prove to enhance overall swing performance even more. This embodiment, like the previous one mentioned, would comprise a glove with an opening along the palm area where the club crosses, having an opening with a length of about 2 inches and a width opening of 1.5 inches (enough to where the entire club could fit inside the opening). Additionally, it would cover essentially all of the weak-hand's Thumb, Forefinger, Ring and Pinkie Finger, while leaving the weak-hand's middle finger at least partly uncovered. This way, when the golfer, using the overlapping grip, places the Pinkie finger of his/her strong hand over and between the covered Forefinger and uncovered Middle finger of his weak-hand, the coordination from the added feel between the two hands will be enhanced not only by the palm opening but also by the partial-fingered glove features. Among the benefits of the present invention would be to offer greater golf consistency and accuracy by solving an unrecognized problem in prior art.

Much like there are three basic finger locking grips when gripping a club (the interlocking, the overlapping and the full-fingered), there are also a few ways that the club could actually cross the palm area when gripping a golf club.

The website http://perfectgolfswingreview.net/grip.htm, offers a basic description as well as a diagram (replicated as FIG. 8). It states that golf instructors identify three different and basic left palmar locations for the grip when executing a full golf swing.

Referring the FIG. 8, The 'D' line represents what he calls a "distance" grip pattern. This grip pattern is often described as a finger grip pattern. The author goes on to say that 'another disadvantage of a finger grip is that it is more difficult to securely hold the grip without the club slipping in the left hand during the swing action.' FIG. 5 illustrates an embodiment that could be used to those individuals who use this grip.

The 'N' line represents what he calls a "neutral grip" pattern. It is also called a low palmar grip pattern, because the grip lies across the low palm, and it is below the hypothenar eminence (heel pad). FIG. 4 illustrates an embodiment that could be used to those individuals who use this grip.

The 'C' line represents what he calls a "control" grip pattern. I refer to this grip pattern as a mid-palmar grip pattern, because it runs across the middle of the left palm, and it lies across/over the hypothenar eminence (heel pad). FIG. 6 illustrates an embodiment that could be used to those individuals who use this grip.

Any of these three grip positions could be used for regular club swings or for putting as well.

Finally, during the course of the swing, the club travels some 35+ feet and the entire time you must keep your eyes focused on the ball. If you place your hands on the club correctly you will be able to feel where the club is in space to optimize both power and control.

An unappreciated but significant advantage that embodiments will give users have to do with a new method in putting. First, by offering a partial palmless glove where the club actually touches the skin of the hand, one can now use the glove for putting. The advantage would be that one can maintain significant feel that would be needed to successfully putt a golf ball, but also being able to offer increased grip as well. Second, this structurally different golf glove would allow a golfer to not have to take off his glove every time he prepared to putt. This unappreciated advantage would now allow a player to eliminate that burdensome and distracting conventional way of putting.

If one were to compare the features that this invention offers, to those of prior art one would immediately see the significant and substantial differences. The present invention provides an immediate feedback mechanism if someone is shooting improperly. The present invention provides the opportunity of having a much more controlled, unified golf swing by increasing the ability of having the more hand coordinated golf swing. Finally, the present invention now offers a device and method by using a glove when putting, a first of its kind. The present invention is therefore better able to increase the performance in the sport of golf by an increased overall grip for a full golf swing as well as for putting The present invention provides substantial benefits than prior art generic open palm gloves by isolating key area only, and thereby offering:

A grip aid whereby the uses may better feel when the hand in good grip position throughout the swing Immediate feedback if the golf club moves Better ability to notice if a golf club moves, especially during the downswing and/or the unhinging of the wrists Gives ability to have better feel on the weak hand, and therefore better overall feel because can feel with both hands and therefore throughout the entire two hand grip By way of example, another sport where embodiments of the present invention would fulfill unmet needs would be in the sport of Basketball, and could be used during practice, warm-up and/or actual game play activities.

The present invention is substantial and significant because it has invented a way to use gloves in the sport of basketball, thereby changing the way the sport can now be played.

Individuals who play basketball have to 'feel' as well as control a ball to perform effectively and although they too could significantly enhance performance in controlling a ball by using grip enhancers, prior art forces them to choose between all feel (and therefore, no glove) or no feel, and thereby being able to use a glove. These players would substantially benefit from developing a way to maintain feel while increasing grip capabilities in select areas of the hand, thereby solving this significant issue. This insoluble problem can now be solved by embodiments of the present inventions.

One embodiment that would help a player shoot better comprises a full-fingered glove—covering all five fingers of the hand—while the palm area of said hand is largely uncovered (or open) in a specially located region of the palm described above as the shooters gap. For all basketball players, but especially for those who cannot generally shoot a basketball very well, the partially-open palm glove over the hand allows them to feel when they're shooting incorrectly (if the basketball touches around the center of the palm area while attempting a shot at the basket, then there is no shooter's gap, and is therefore generally considered as using bad shooting form). This would especially be true when shooting a basketball from the free-throw line or outside of the perimeter. Eventually, these athletes may not need this embodiment for shooting once they understand and learn to maintain their shooter's gap throughout the basketball shot. The open palm could also allow for some ventilation as well. The benefits of this glove include the ability to enhance the senses around the uncovered palm (relative to the other parts of the hand) so that the basketball player could more easily know when the basketball is touching the palm, generally indicating bad shooting form. The palm opening can vary in size and shape as long as it doesn't extend significantly beyond substantially the middle of the palm area.

The open palm opening can have a length of, for example, 2 inches, and a width of, for example, 2 inches. Other similar embodiments could have different lengths and shapes. For example, embodiments could have a lightbulb shape design, narrowing down through the heel crease (or following the lifeline), such that the length of the embodiment may be close to 2 inches but the width would vary from about 1.5 inches near the top of the palm area, preferably where the metacarpal joints begin, and narrowing to practically 2 centimeters at the end of the wrist crease. One of the surprising results is that the glove will give the basketball player the ability to put more backspin on the basketball when shooting the basketball. More backspin would, of course, give the ball the ability of bouncing around the hoop if the basket is not initially made, and providing more of what is commonly known as 'a shooters touch.' The ability of the user to have more backspin would be uniquely created with the glove palmar portion having a top portion that covers the metacarpophalangeal joints of the user's fingers thus creating increased grip capabilities along the joints that can create the backspin.

A new method of practicing shooting a basketball can now exist whereby a player can place an embodiment on her shooting hand, shoot a basketball in her preferred manner, and immediately upon shooting the ball, she can quickly and easily determine if she used proper shooting form and not allow the basketball to touch the center area of her palm. After determining that the shooters gap was maintained in her shot, she can then continue to discern if other aspects of her shooting form (that aren't related to the present invention) were properly executed (such as follow-through, releasing the ball at the right moment, etc). If the ball did touch her palm area, she could quickly adjust her shot and try again. A critical benefit here is the ability to quickly assess her shot and therefore being able to adjust accordingly. The result, among other things, would be an increased shooting percentage and better overall performance because, not only would she be able to adjust her shot with more success, but she would also benefit from the grip enhancing ability that a glove would provide to the other areas of her hand.

One often sees basketball players using cotton wrist bands so that they can wipe their hands of perspiration during game play to better ensure that they will not mishandle the basketball, and affectionately be called 'butter fingers.' This is especially important in shooting a basketball. The present invention will now allow a user to play basketball with a glove thereby significantly diminishing the need to use cotton wrist bands.

The present invention is significantly different than prior art. The present invention is unique because it provides a basketball player with a glove that offers, among other things, an immediate feedback mechanism. The present invention provides this feedback mechanism by lessening the skin sensitivities outside of the shooter's gap area, or conversely, it heightens the exposed palm skin (because of the open area in the around the middle of the palm) relative to the area outside of the open area (because it is covered by the glove), thereby making it easy to 'feel' if the individual is shooting, dribbling or catching a basketball using bad form.

For example, as previously mentioned, proper shooting generally requires that one adheres to certain shooting mechanics. If the basketball touches the middle of the palm area during a shot, it is generally considered bad shooting form. With the present invention, a player could practice shooting with, say FIG. 1, and if there is even a slight violation, and the player unintentionally allows the ball to touch the center area of the palm, the player would immediately feel it, and then adjust accordingly. This is also why the present invention is significantly different than other palmless handcovers, in that by concentrating the palmless area opening to the shooters gap region, the present invention provides new and surprising results—immediate feedback on proper shooting and dribbling form. This is one of the primary reasons why the more generic full-fingered gloves are not used in basketball today because this need to feel and adjust is critical.

Basketball players have also chosen not to use generic palmless gloves as well. If one were to compare the features that this invention offers, to those of prior art, such as Eyman or Mosley, one would immediately see the significant and substantial differences. The present invention provides an immediate feedback mechanism if someone is shooting improperly; Eyman and Mosley do not. The present invention provides an immediate feedback mechanism if someone is dribbling a basketball improperly; Eyman and Mosley do not. Eyman and Mosley do not offer these because they did not discover that, although a partial palmless glove could offer these benefits, it could only be done if one were to leave only a specific range of the palm open. In fact, leaving an area outside of the middle of the palm would render the glove rather useless, with regards to these benefits.

Embodiments could also satisfy long felt needs when it comes to dribbling a basketball. According to the book "Basketball for High School Players and Coaches," (1955) Carl Bachman describes proper fundamentals of basketball dribbling: "Certain fundamentals apply to all phases of ball handling: Looseness of finger and wrist action is important, practice spinning the ball on fingertips; a basketball should never touch the heel of the hand and seldom, if ever, touch the palm." One embodiment of the present invention could comprise of an all open-fingered, partially open palm glove for either the strong-hand or the weak-hand. Embodiments could have a radius of up to about 0.75 inches, with the midpoint in the exact middle of the palm (the inventors palm, for example, is 4 inches in length and approximately 3 inches in width. So the midpoint in the inventors hand would be 2 inches below the digital crease and 1.5 inches across the edge of the palm). Embodiments could also extend through the wrist area, depending on how much of the heel is uncovered. These embodiments could help a dribbler develop and use proper dribbling form, especially on her weak-hand. This embodiment would more generally help any player, and likely could be used, for example, by those playing the position of Guard while practicing proper dribbling on their strong-hand, as well as Forwards and Centers during actual game play for added support on their weak-hand.

Another embodiment for basketball play is in the form of an all partially-open fingered, partially open palm glove. All five fingers are only partially covered, perhaps up to about the first joint of each finger. Additionally, the palm area would much more narrowly uncovered, say one inch in length and 0.5 inch in width. Additionally, it could have grip enhancing element along the top portion of the palm area (where the palm connects to the fingers, along and below the digital crease). This embodiment would give a basketball player the ability to better catch a ball, thus eliminating the consistent problem often found in Forwards and Centers losing control of passes. The embodiment would also provide a player with a stronger grip on the ball when passing a ball as well as provide some moisture management control, thus minimizing turnovers often caused by passers, especially in Guards. The grip enhancers could comprise PVC dots to provide add grip support, while the shooters gap opening would still allow for sensitivities necessary in shooting success. The narrow or smaller opening would then alert the user that the shooters gap had been violated but only if the violation was severe (i.e., she was nearly palming the ball). This might also be a preferred embodiment for those players who already have superior shooting form. Lebron James, for example, is a professional basketball player who has superior shooting form. History shows, however, that in the fourth quarter of a game, even his shooting performance may wane, and he has to quickly assess what part of his shooting mechanics is not being properly executed. This embodiment would give Mr. James the necessary feeling required if he suddenly violates the shooters gap, but again only if the violation is fairly significant. Additionally, many players, including Mr. James, use talcum powder on their hands to ensure they can better catch and control a ball. This embodiment would be a significant improvement to this current method by offering a grip enhancer to the hand.

Among the many benefits that embodiments of the present invention offer are that they allow a user to:

Maintain feel in key areas of palm and fingers
Significantly develop proper shooting and dribbling.
Train to put one's hand in the perfect shooting position
Increase grip of the basketball
Improve overall performance in task execution
Offer more stability and control of the ball
Create greater consistency on play execution
Have less ball mishandles
Lower turnovers
Result in Higher shooting percentages
Offer increased grip in areas where the basketball is supposed to touch the palm Although the description of the present invention only discussed three sports, it is understood that other sports might benefit as well (such as in baseball and volleyball). In addition, only some embodiments have been discussed and in no way is intended to limit all the various embodiments that the present invention provides, such as but not limited to, different designs and recess shapes. For example, embodiments can easily be developed for easy opening, where a part of the back of the hand opens up, using VELCRO. Additionally, these embodiments can be used by men and women, boys and girls, as well as those that whose dominant hand is the right hand or the left. Embodiments can be used in combination with each other. Additionally, the open palm opening could be of different shapes and dimensions, according to the claims, and could be constructed from different fabrics, for example, to offer a thin layered and light glove embodiment.

The grip-enhancing means as claimed, may comprise of various materials forms and designs including, but not limited to, grooves, foams, fabrics, PVC dots, perimeter patching designs, a plurality of projections, a plurality of depressions or combinations thereof. Furthermore, they could comprise of thermal neoprene construction, neoprene coated latex to provide a non-slip grip in oily conditions, polyurethane-coated fingertips, thumb bulge, and around the palmar digital crease for added grip, or other grip-enhancing textures. The grip-enhancing means create a higher coefficient of friction than the surrounding glove material and thereby significantly increasing grip capabilities along that particular portion of the glove body when the glove is worn.

BRIEF DESCRIPTIONS OF THE DRAWING

It is expressly understood that the following descriptions and drawing are for illustration purposes only, and in no way are intended to limit the scope of the present invention and its various embodiments. For example, the drawings are of drawings of embodiments for the left hand but can easily be created for the right hand, and can be used by men and women, boy and girls.

DETAILED DESCRIPTION OF THE DRAWINGS

It is expressly understood that the drawings are for the purpose of illustration and description only and are not intended as a definition of the limits of the invention.

Figure 1:
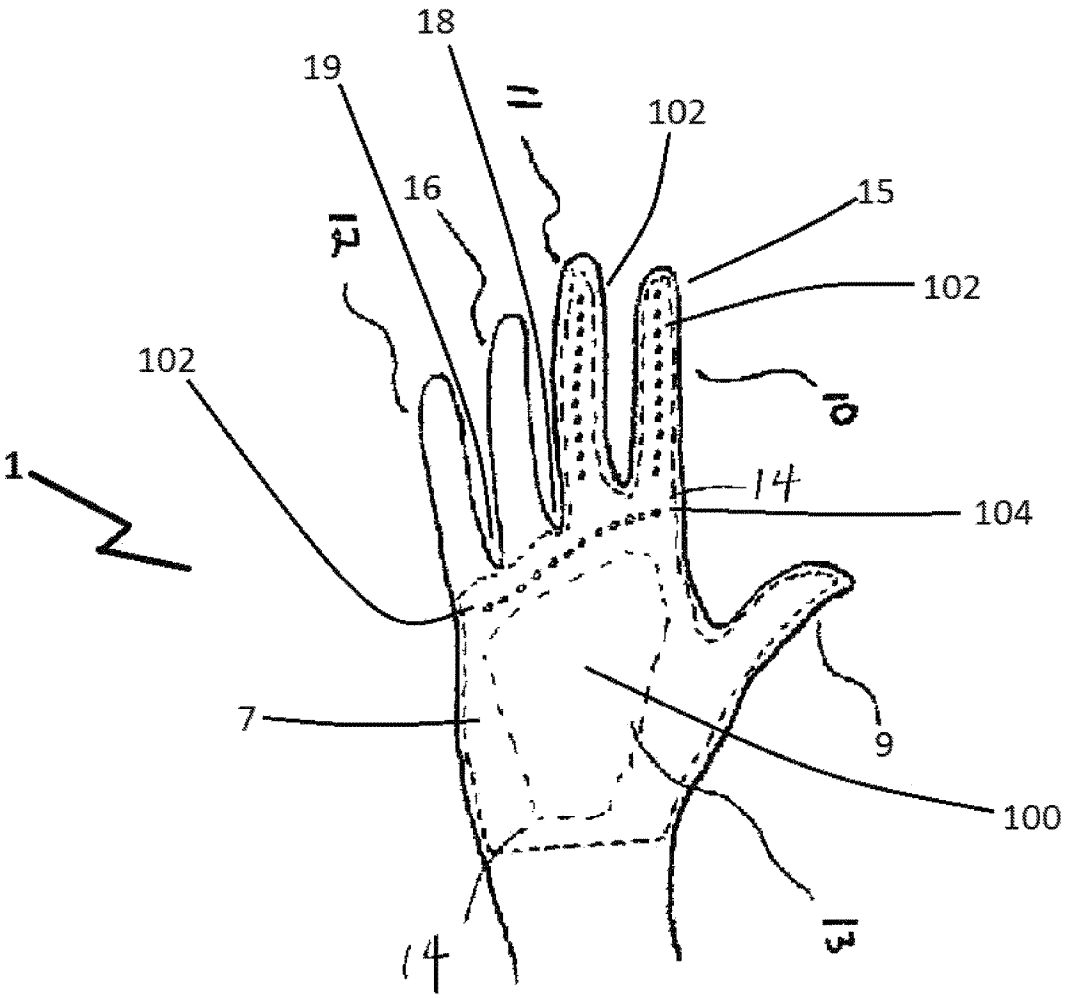
FIG. 1 is a drawing of a first embodiment, palmar side.
Figure 10:
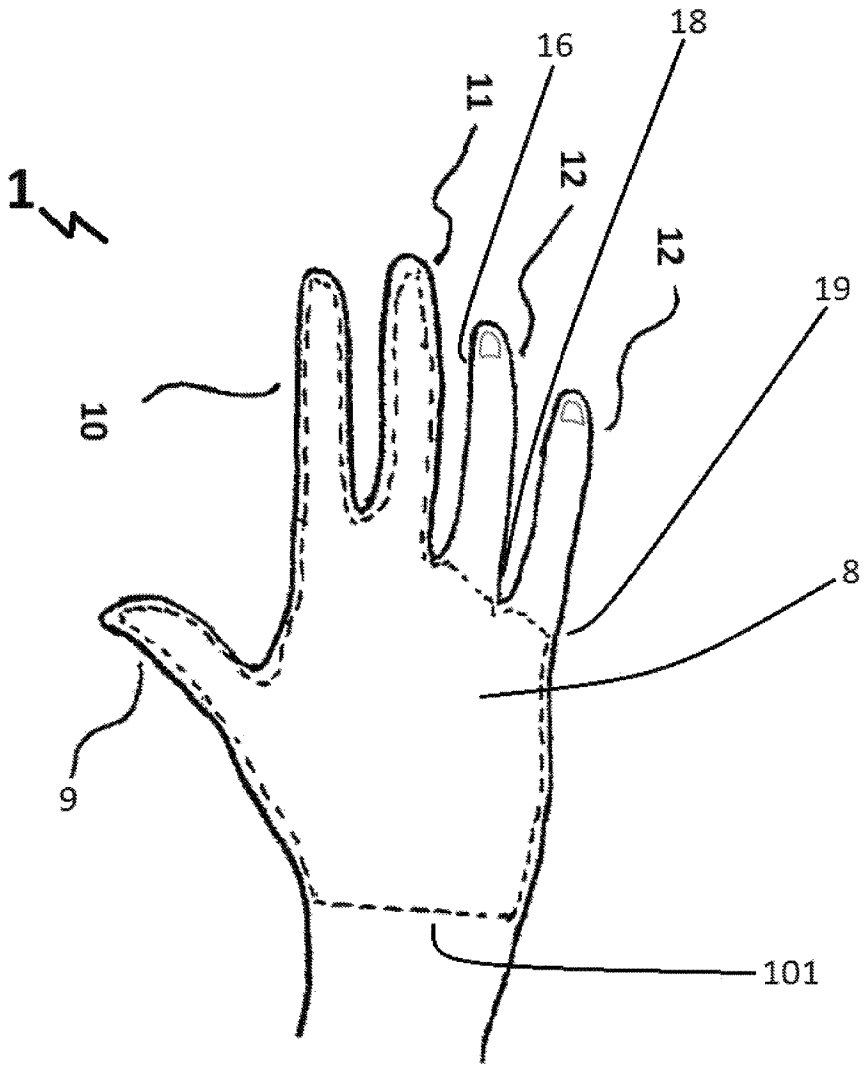
FIG. 10 is a drawing of the first embodiment, dorsal side.

In FIG. 1 & FIG. 10, the present invention is shown as a partial-fingered glove 1. This particular glove could be made of cabretta leather to offer moisture and perspiration resistance. The Thumb 9 and Forefingers 10 are entirely covered by the glove thumb stall 9 and forefinger stall 10, respectively. The Middle Finger 11 is also entirely covered by the glove middle finger stall 11. The Ring 16 and Pinkie Fingers 12 are both entirely uncovered. Substantially the middle of the palm is uncovered 13 by providing a recess that is adapted to extend substantially along the middle of the user's palm when the glove is worn. The recess 13 in the palm leaves uncovered the center of the palm 100 and extends all the way down through the heel crease 14. It has a length of up to 2 inches and a width of up to 1.5 inches, narrowing down as it approaches the wrist crease 101. This embodiment leaves a larger opening 13 which could be used particularly during drills, whereby even a slight violation of allowing the basketball to touch the palm area, would be felt. This embodiment also has PVC dots 102 along the fingers enclosed by the glove as well as along the top portion of the palm 104, thereby significantly increasing control of a basketball. The glove preferably also comprises of other grip-enhancing of materials forms and designs such as, but not limited to, grooves, foams, fabrics or combinations thereof. The novel features of this embodiment allow a player to focus her attention on maintaining a shooters gap while attempting a shot, and provides for instant feedback if said gap is breached and the shot violates the gap and touches the open area of the palm 13. The palmar (front) view of the glove 1 is drawn in FIG. 1 and the dorsal (back) view of the same glove is drawn in FIG. 10.

Figure 2:
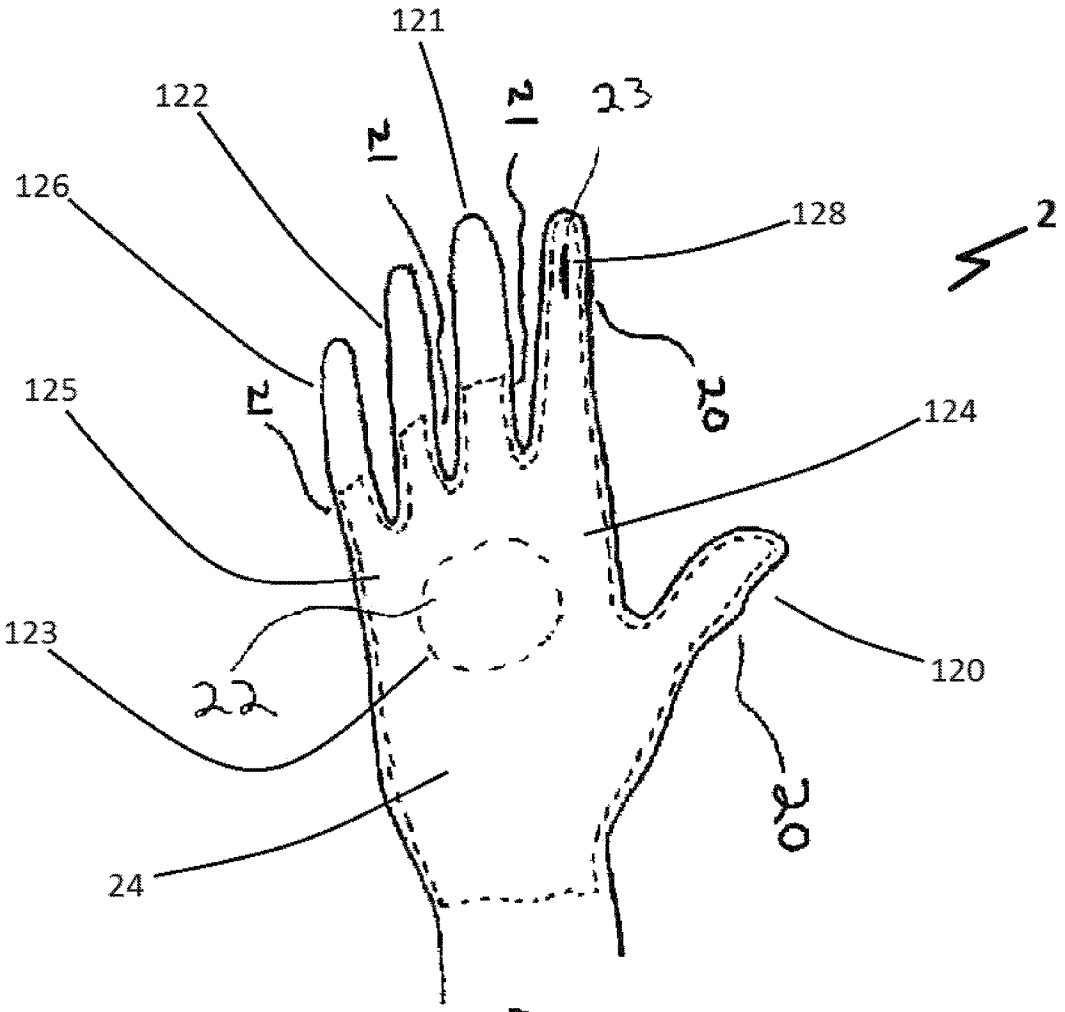
FIG. 2 is a drawing of a second embodiment, palmar side.
Figure 11:
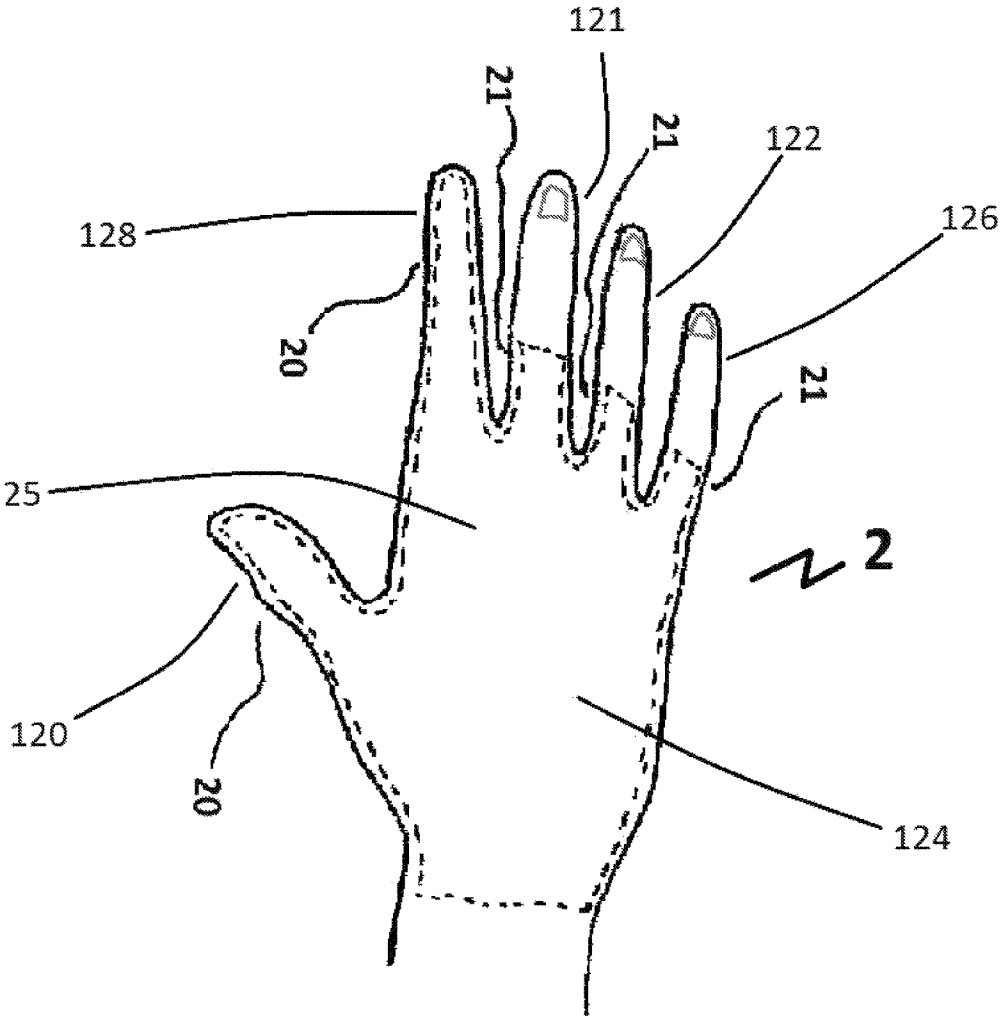
FIG. 11 is a drawing of the second embodiment, dorsal side.

In FIG. 2 & FIG. 11, the present invention is shown as a partial-fingered glove 2. This particular glove can be made of polyester and cotton for superior comfort. The glove is configured such that the user's Thumb 20 and Forefingers 20 are entirely covered by the glove. In addition, the Middle 21, Ring 21 and Pinkie Fingers 21 are all partially covered, about one-third the way up the fingers, to about the first knuckle 21 by the glove. The glove is further configured such that the middle area of the palm 22 is open, but much more narrowly. The opening is substantially on the middle of the palm area, having a radius of up to about 1 inch, for example, thereby defining the boundary of the palm opening substantially on the middle of the user's palm. Similar embodiments could range from 0.5 to 1.25 inches in radius. This embodiment could be used in actual basketball game play, where the player would be alerted if he/she was using improper form, but only if the violation was severe by the exposed palm portion of the user's hand. This embodiment can also have a grip enhancing means design, in the form of grooves for example, along the perimeter 123 of the open palm. It is made of perspirant-resistant materials and spandex. The embodiment, for example, could further comprise a weather-resistant and perspirant-resistant forms and designs including water-resistant materials 124 or hole designs for moisture management, or combinations thereof. The glove can have grooves throughout said fingertip 23 to further enhance grip. Furthermore, it has PVC dots 125 across the top of the palm, to increase grip along the top of the user's palm. It is circular in shape. The grip enhancing means are adapted to provide a higher coefficient of friction than the surrounding glove body surface. This embodiment is most useful with actual game play by its unique glove structure by exposing a critical portion of the middle of the user's palm as well as completely exposing the user's ring finger and pinkie finger when the glove is worn. The palmar (front) view of the glove 2 is drawn in FIG. 2 and the dorsal (back) view of the same glove is drawn in FIG. 11.

Figure 3:
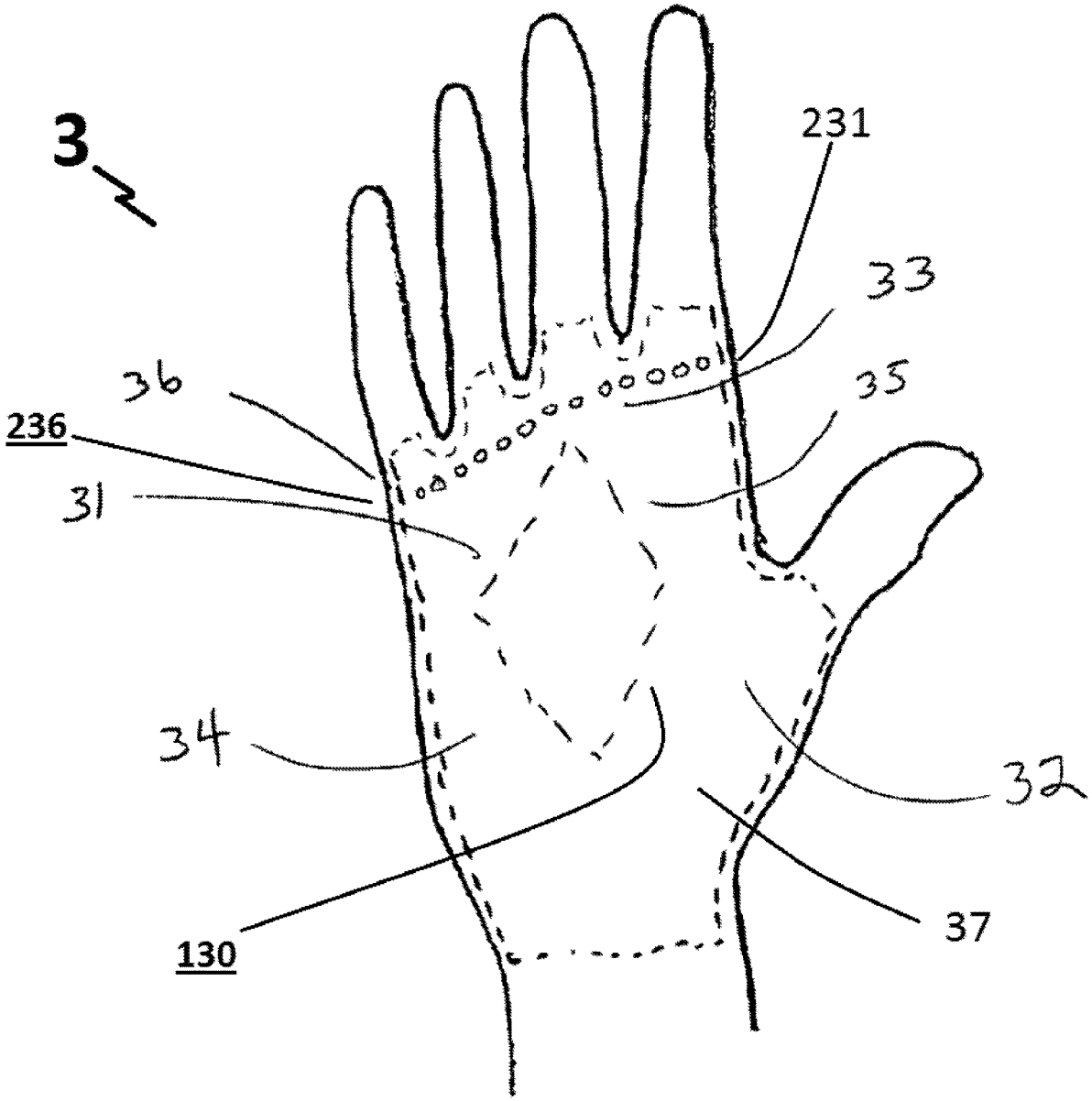
FIG. 3 is a drawing of a third embodiment, palmar side.
Figure 12:
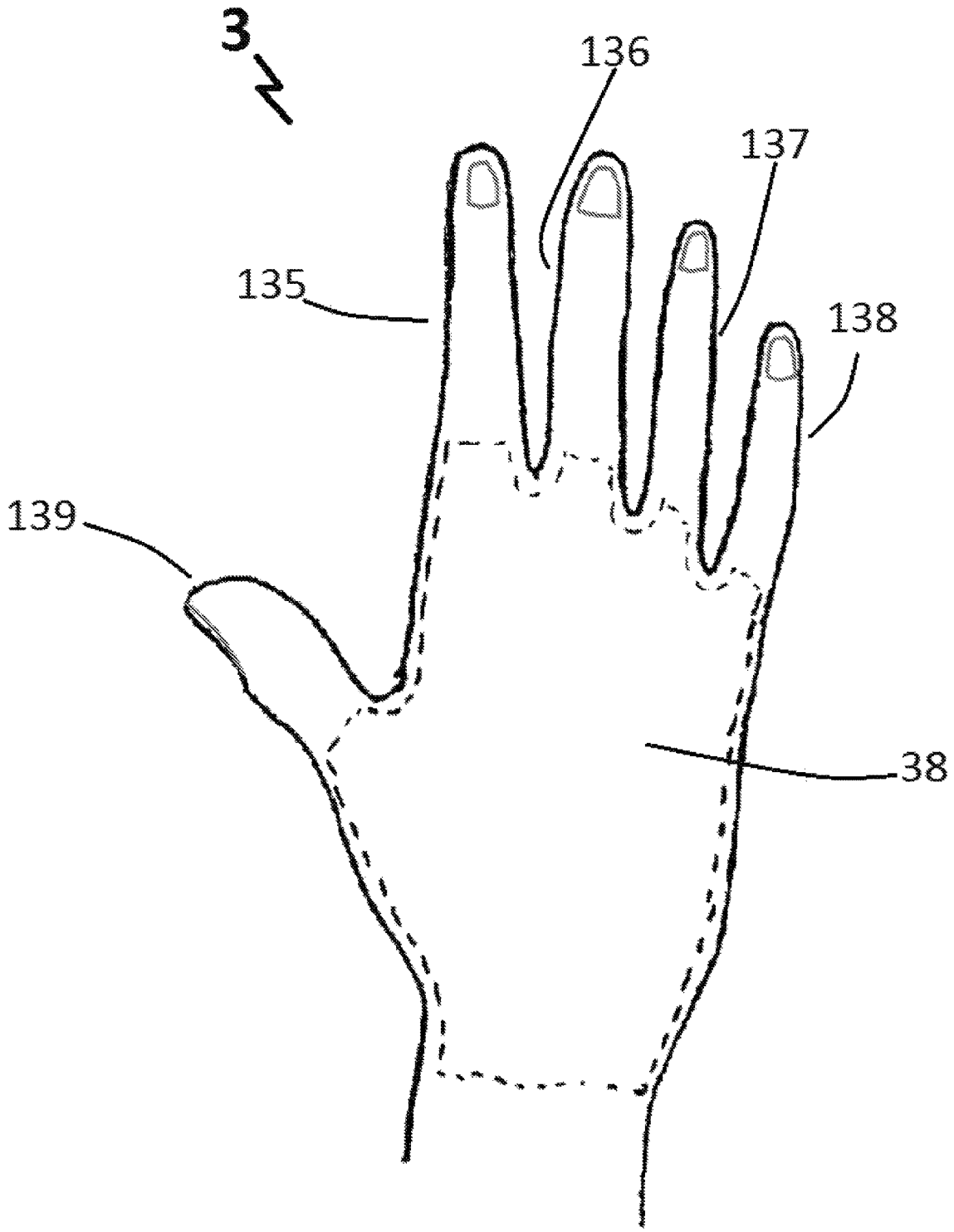
FIG. 12 is a drawing of the third embodiment, dorsal side.

In FIG. 3 & FIG. 12, the present invention is shown as an all open-fingered glove 3. The inside palm area 31 is uncovered and is a diamond shape, yet still substantially in the middle of the palm area of the user's hand when the glove is worn. It follows the edge of the thumb bulge 130 but not on it 32. Furthermore, it is bounded by the palmar digital crease area 33 and the hypothenar eminence 34. In addition, has a highlighted area along the perimeter of the opening 35, so that trainers can more easily see if violation taking place. This embodiment can further comprise of other various types of materials, forms, and designs aforementioned including stretch materials and designs, mesh fabrics, recycled and flexible materials, cottons, rayon, spandex, fleece, leathers and synthetic leathers, rubbers, plastics, polyester, or combinations thereof. This embodiment might be particularly attractive to the amateur and intermediate basketball players who want to ensure proper shooting form is being executed. Additionally, these players would also appreciate the grip enhancer capabilities having a grip enhancer 236 along the top portion 36 of the palm, where the basketball often touches the hand and is used to maneuver the basketball.

Figure 4:
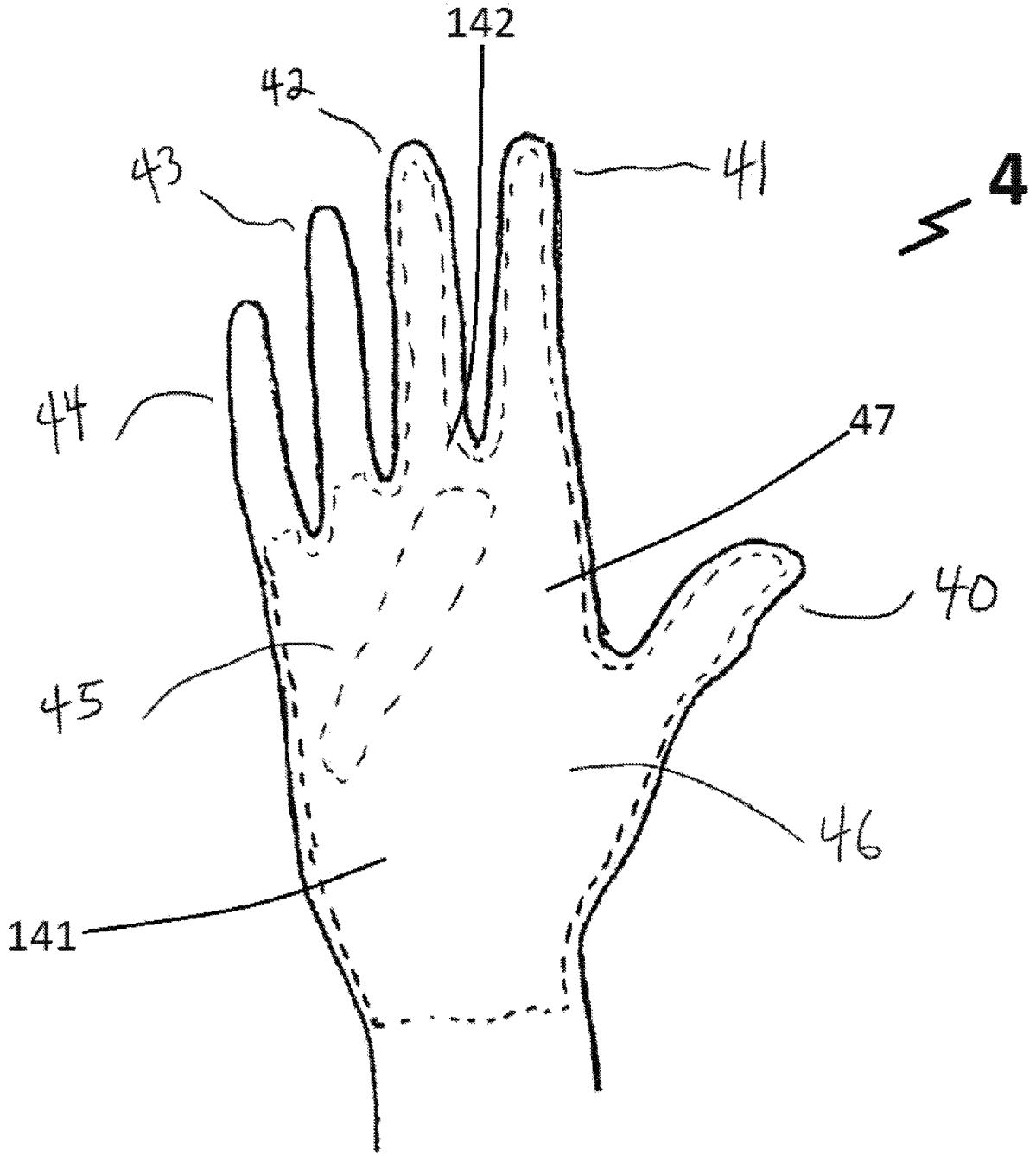
FIG. 4 is a drawing of a fourth embodiment, palmar side.
Figure 8:
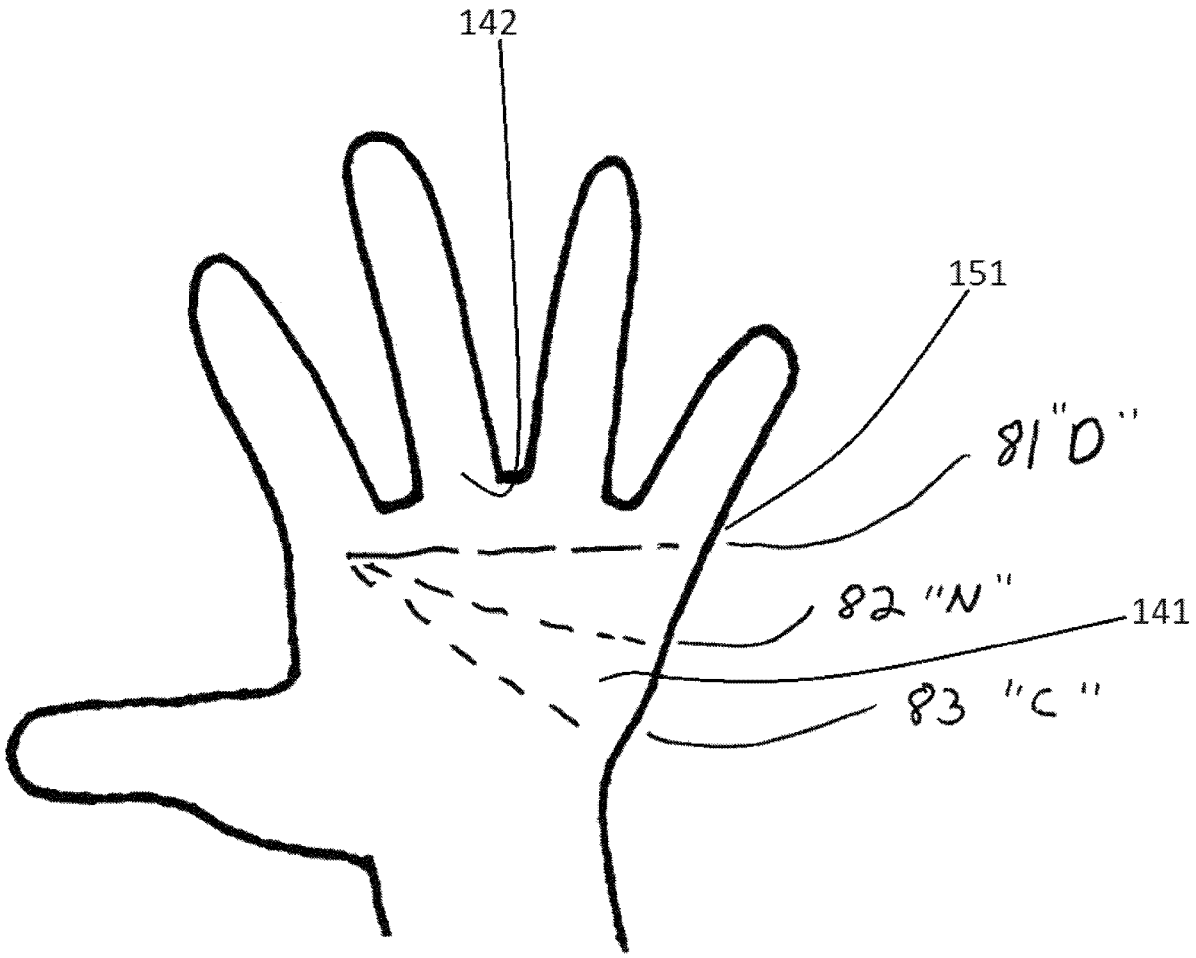
FIG. 8 is a drawing showing the three basic way a golf club crosses the palm area of a user.
Figure 9:
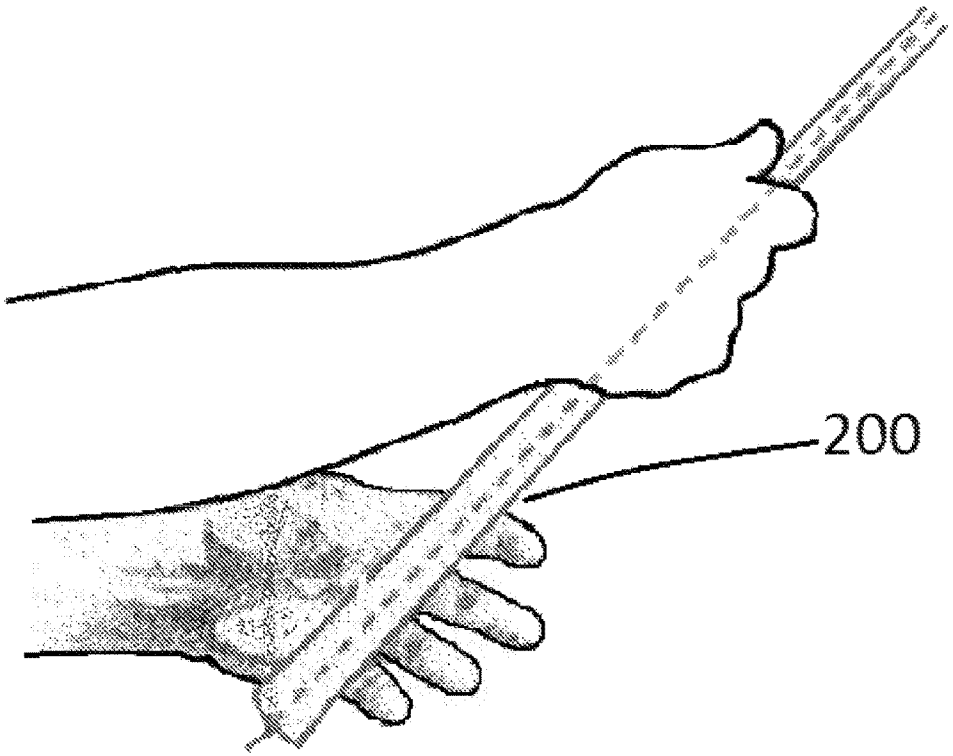
FIG. 9 [Related Art]
FIG. 9 is a drawing of a typical way of gripping a golf putter.
Figure 13:
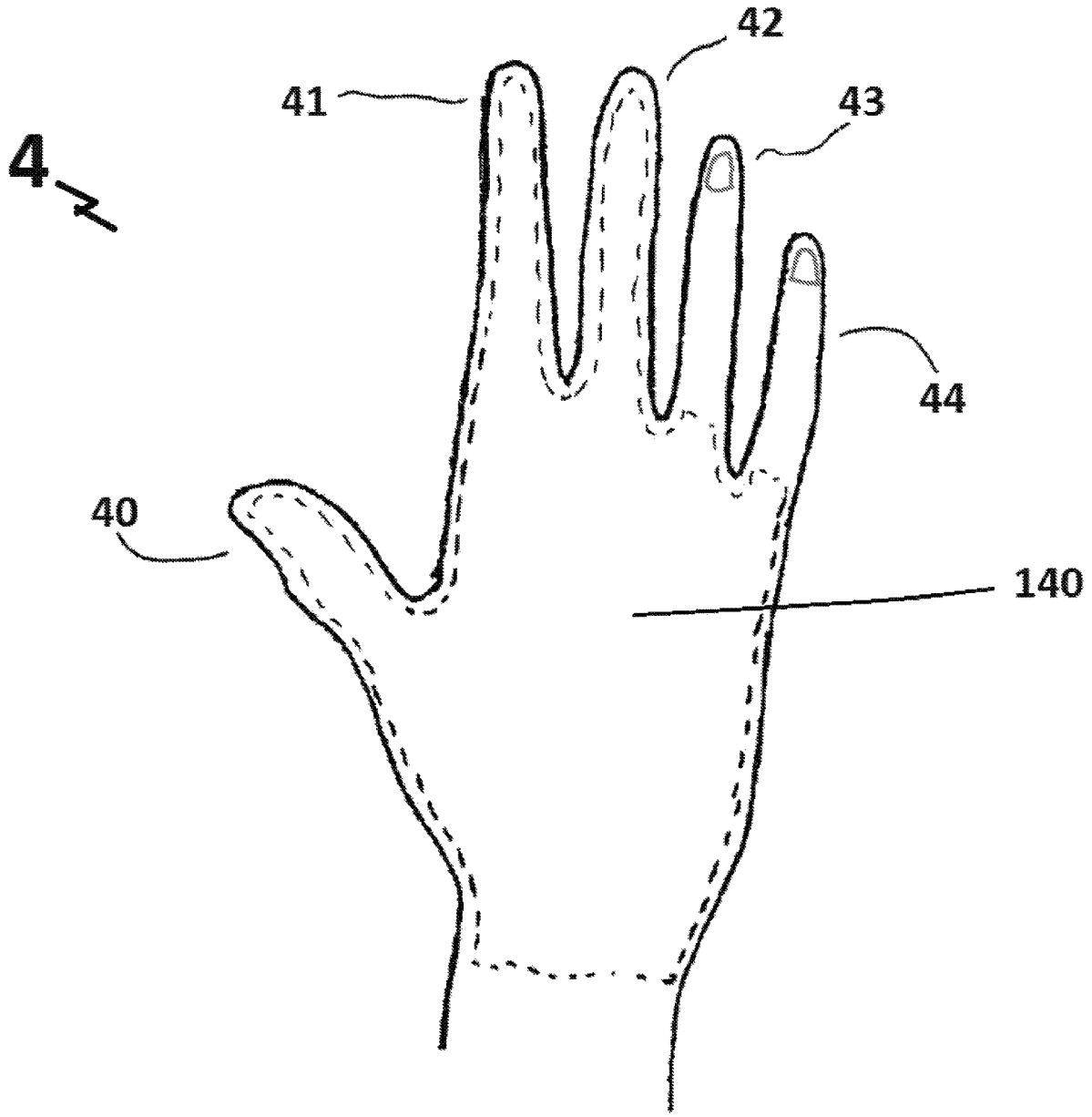
FIG. 13 is a drawing of the fourth embodiment, dorsal side.

FIG. 4 & FIG. 13 shows an embodiment as a partial-fingered, palmless glove 4. Specifically, the thumb 40, forefinger 41 and middle fingers 42 are essentially entirely covered when the glove is worn. The ring finger 43 and pinkie finger 44 are completely uncovered when the glove is worn. Furthermore, the palm is partially open 45. The length of the palm opening is up to about 3 inches in length and up to about 1.5 inches in width. This embodiment is critically valuable to those golfers who grip a golf club positioned along the 'N' path 82 as shown in FIG. 8 & FIG. 9 Note that the top of the grip 200 lies below the hypothenar muscle bulge and that it lies in the lower palm between the hypothenar eminence 141 and the base of the middle finger 142. Note that the grip also lies diagonally across the lower palm so that it crosses the proximal phalanx of the middle finger. When the fingers are closed around the golf club handle, three fingers (middle finger, ring finger and pinkie finger) of the non-dominant hand—the non-dominant hand—(3rd, 4th, 5th fingers) are primarily responsible for gripping the club grip firmly in the left hand. The index finger lies more loosely across the grip. One should remember that the non-dominant hand golf grip is primarily a three-finger grip, and not a palm grip. The non-dominant 3rd, 4th and 5th fingers are primarily responsible for gripping the club, and the grip pressure should be firm—it should not be possible to pull the grip end of the club out of the non-dominant hand if another person pulls on the clubhead end of the club, and it should not be possible for that person to twist the club in one's one-dominant hand if he attempts to twist the clubhead end of the club. A golfer must maintain a solid hand grip (using the dominant 3rd, 4th and 5th fingers) should always be firm. The embodiment can comprise of various a weather-resistant and perspirant-resistant materials, forms and designs including, but not limited to, water-resistant materials or hole designs for moisture management, or combinations thereof and aforementioned. Referring more particularly to the embodiment drawing, the palmar (front) view of the glove is drawn in FIG. 4 and the dorsal (back) view of the same glove is drawn in FIG. 13. This partial-fingered embodiment provides a glove having a dorsal portion 140, a palmar portion 47 for overlaying respective back and palm regions of a human hand, said dorsal and palmar portions having distal and proximal ends with a plurality of digital segments (or stalls) projecting from said distal ends. Additionally, the glove is configured such that a user's ring finger 43 and pinkie finger 44 may individually extend through said glove and expose the entire ring finger 43 and pinkie finger 44 when the glove is worn. The glove includes a glove body having a back portion covering the back of the hand 140, and a front portion covering substantially all of the palm or front of the hand 47. A critical portion of the user's palm is open and therefore uncovered 45 when the glove is worn thereby exposing the skin and significantly increasing tactile sensations along the exposed palm area. The palm opening extends to expose the lower palm, and is adapted to extend between the hypothenar eminence 141 and the base of the middle finger 142, thereby defining the boundary and location of the palm opening. The rest of the user's palm including the hypothenar eminence is therefore essentially completely covered by the glove palm portion. The glove body includes a forefinger stall 41 and a thumb stall 40 each adapted to receive a forefinger or thumb, respectively, therein. In the illustrated embodiment, the glove is constructed such that the thumb digital segment 40, the forefinger digital segment 41 and the middle finger digital segment 42 enclose and completely cover the user's thumb, forefinger and middle finger in their entirety, including enclosing the fingertips. The glove does not comprise of finger stalls for a user's ring finger or pinkie finger. Therefore, the ring finger and pinkie fingers are both all completely uncovered when the glove is worn. In other words, the distal, middle and proximal phalanges of the user's ring and pinkie fingers are completely exposed when the glove is worn.

Figure 5:
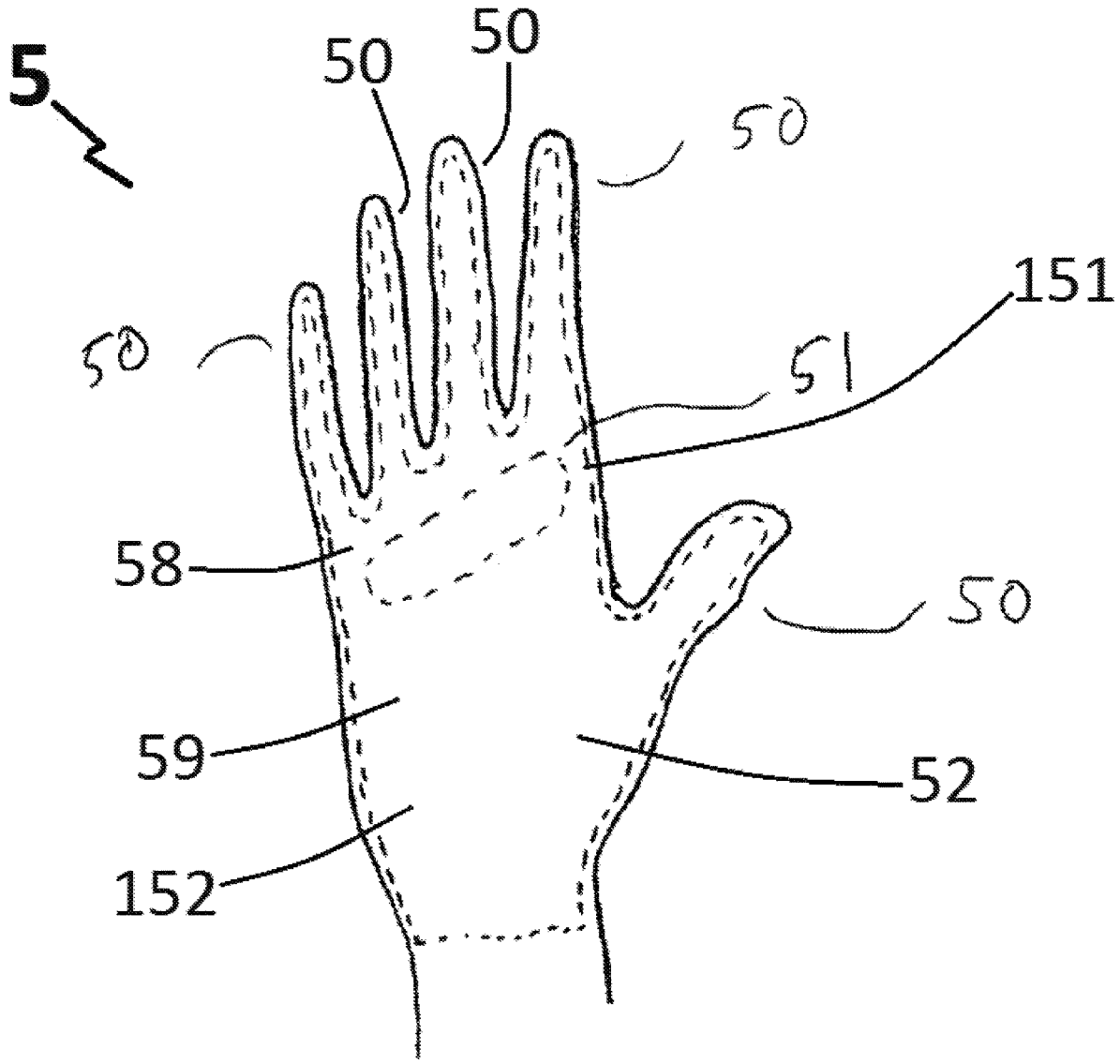
FIG. 5 is a drawing of a fifth embodiment, palmar side.
Figure 14:
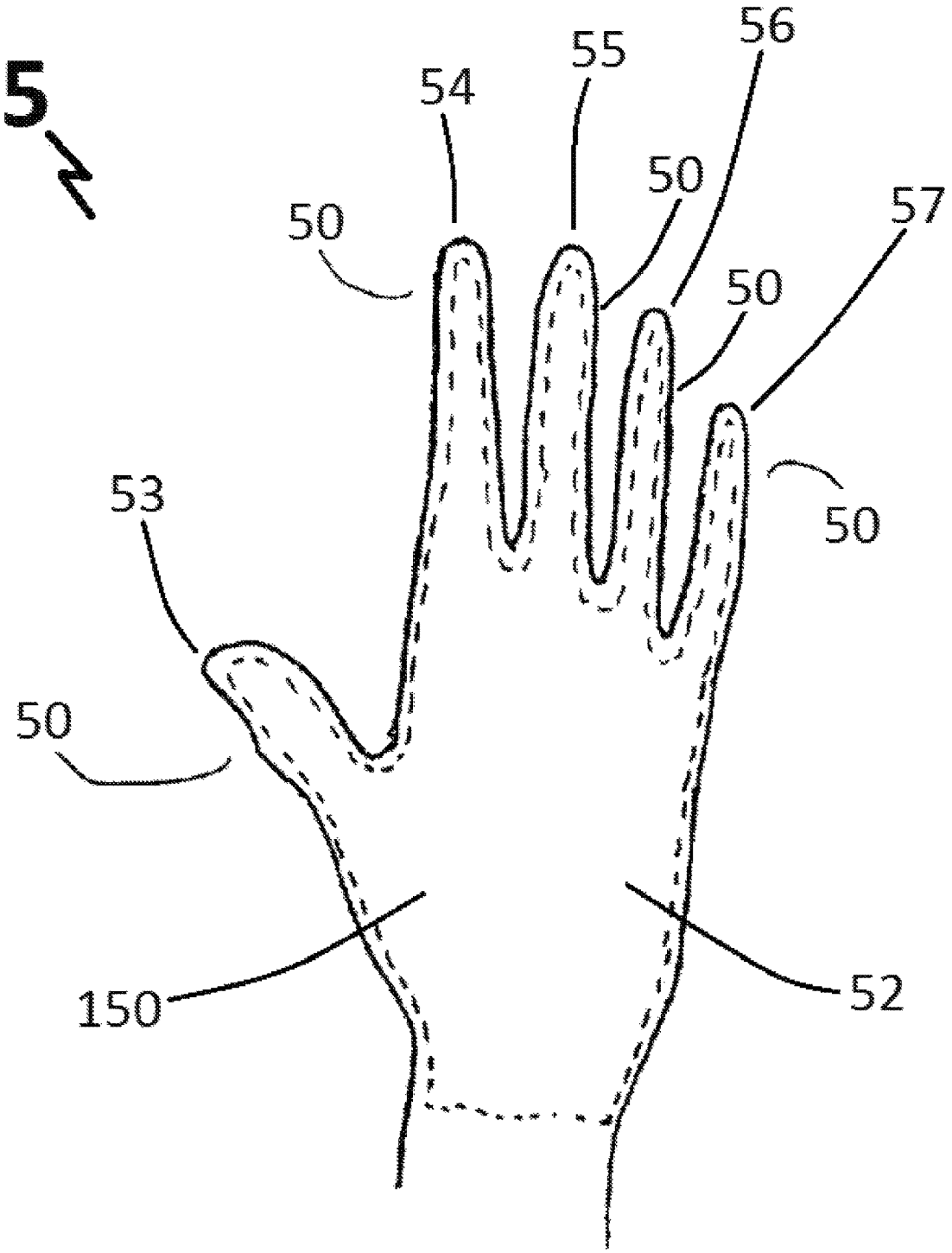
FIG. 14 is a drawing of the fifth embodiment, dorsal side.

FIG. 5 & FIG. 14 show another embodiment of the present invention 5. This embodiment is most useful for those uses who grip the golf club along the 'D' line 81 as represented in FIG. 8. All of the user's fingers are essentially completely covered 50. The glove palmar portion comprises an opening that is adapted to expose a specific and important portion of the user's palm when the glove is worn. Specifically, the opening creates an open palm 51 which is opened just below the palmar digital crease 58, and can extend down up to 2.5 inches. This particular glove could be made of any glove forming material aforementioned, such as cabretta leather 52, for example, to offer moisture and perspiration resistance. The thumb, forefinger, middle finger, ring finger and pinkie finger of the user's hand are all entirely covered by the glove thumb stall 53, forefinger stall 54, middle finger stall 55, ring finger stall 56, and pinkie finger stall 57, respectively. The glove palmar portion opening exposes the palm 51 of the user and is opened just below the palmar digital crease 58, and can extend down up to 2.5 inches. A critical portion of the user's palm is thereby exposed thereby creating heightened tactile sensitivities along the exposed palm area. The length of the palm opening extends across the user's palm along and exposes the 'D' path 151 when the glove is worn. The remaining portion of the user's palm is covered including the user's hypothenar 152 and thus without said opening. Continuing to describe the embodiment from a more technical perspective, the palmar (front) view of the glove embodiment is drawn in FIG. 5 and the dorsal (back) view of the same glove is drawn in FIG. 14. This partial-fingered embodiment provides a glove having a dorsal portion 150, a palmar portion 59 for overlaying respective back and palm regions of a human hand, said dorsal and palmar portions having distal and proximal ends with a plurality of digital segments (or stalls) projecting from said distal ends. The glove includes a glove body having a back portion covering the back of the hand, and a front portion covering substantially all of the palm or front of the hand. The glove body includes a thumb stall 53, a forefinger stall 54, a middle finger stall 55, a ring finger stall 56, and a pinkie finger stall 57 each adapted to receive a thumb, forefinger, middle finger, ring finger, and pinkie finger of the user's hand, respectively, therein. In the illustrated embodiment, the glove is constructed such that the thumb digital segment 53, the forefinger digital segment 54, the middle finger segment 55, the ring finger segment 56 and the pinkie finger digital segment 57 enclose the user's thumb, forefinger and middle finger in their entirety, including enclosing the fingertips of the thumb and fingers of the user's hand.

Figure 6:
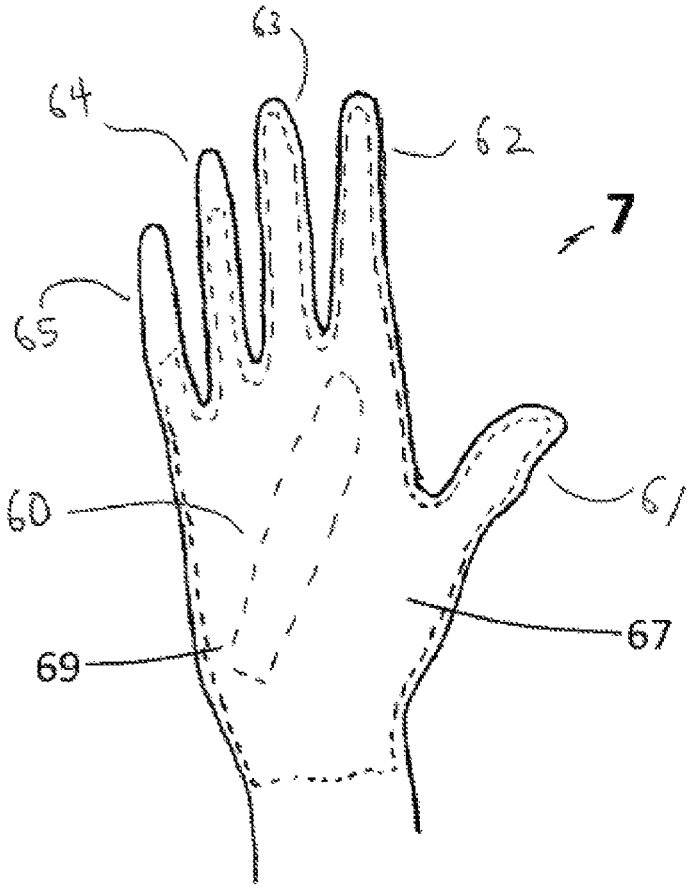
FIG. 6 is a drawing of a sixth embodiment, palmar side.
Figure 15:
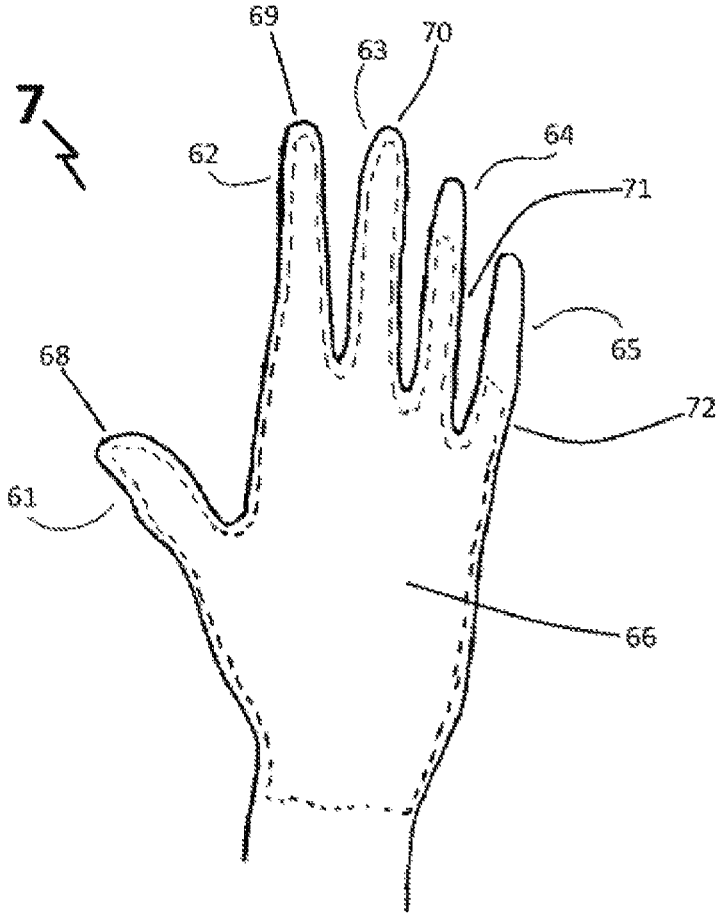
FIG. 15 is a drawing of the sixth embodiment, dorsal side.

FIG. 6 and FIG. 15 draw another embodiment of the present invention of a glove 7 with an opening along the palmar side of the glove.

This embodiment is most useful for those uses who grip the golf club along the 'C' path line 83 as represented in FIG. 8. This is also referred to as a mid-palmar grip pattern, because it runs across the middle of the user's palm, and it lies across/over the hypothenar eminence (heel pad) 69. The palm opening would, therefore, mimic this path 60. The opening length would be up to about 4 inches, to be able to cross most of the palm in a diagonal fashion. The width of the opening can be up about 1.5 inches (thinner than FIG. 5 because these embodiments would not be applicable to other sports, such as football). The thumb 61, forefinger 62 and middle finger 63 of the user's hand are all essentially completely covered when the glove is worn. The user's ring finger has its fingertip uncovered 64. The user's pinkie finger top two joints are also uncovered 65. Describing this embodiment from a more technical perspective, the palmar (front) view of this glove embodiment is drawn in FIG. 6 and the dorsal (back) view of the same glove is drawn in FIG. 15. This partial-fingered embodiment provides a glove having a dorsal portion 66, a palmar portion 67 for overlaying respective back and palm regions of a human hand, said dorsal and palmar portions having distal and proximal ends with a plurality of digital segments (or stalls) projecting from said distal ends. The glove includes a glove body having a back portion covering the back of the hand 66, and a front portion covering substantially all of the palm or front of the hand 67. The glove body includes a thumb stall 68, a forefinger stall 69, a middle finger stall 70, a ring finger stall 71, and a pinkie finger stall 72 each adapted to receive a thumb, forefinger, middle finger, ring finger, and pinkie finger respectively, therein. In the illustrated embodiment, the glove is constructed such that the thumb stall, the forefinger stall and the middle finger stall enclose the user's thumb, forefinger and middle finger in their entirety, including enclosing the fingertips. In other words, the distal, middle and proximal phalanges of the user's thumb, forefinger and middle fingers are all completely covered when the glove is worn. Additionally, the glove further comprises of ring finger stall 71 that is designed to expose the user's fingertip when the glove is worn. The ring finger stall is therefore designed to overlay the proximal and middle phalanges of the user's ring finger but leaves the distal phalanx (the fingertip) uncovered. Additionally, the glove further comprises of pinkie finger stall 72 that is designed to expose the user's top two joints 65 when the glove is worn. The pinkie finger stall is therefore designed to overlay the user's proximal phalanx when the glove is worn.

Figure 7:
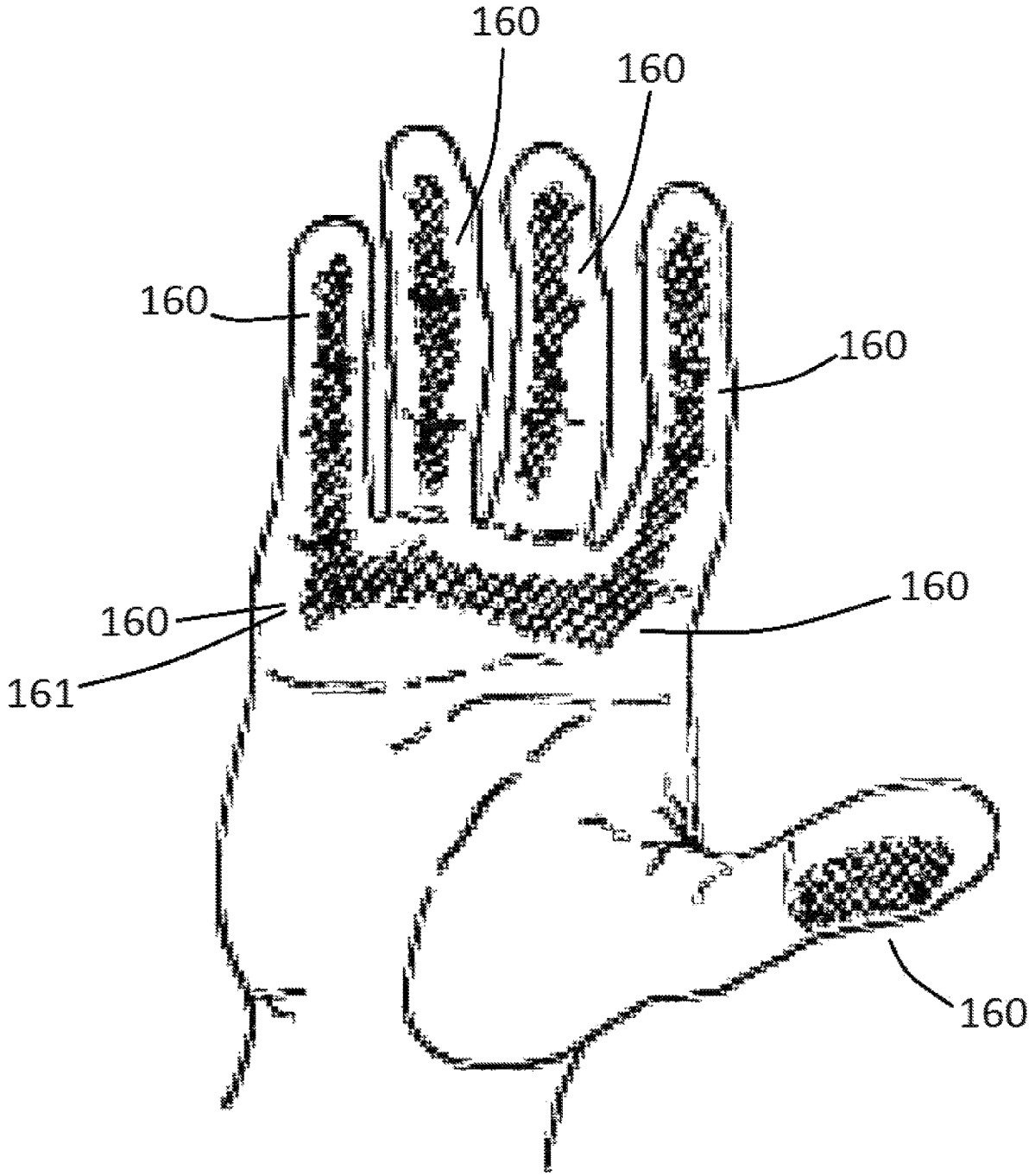
FIG. 7 [Related Art]
FIG. 7 is a drawing showing where the hand of a quarterback generally touches a football.

FIG. 7 is a related art drawing showing where the hand of a quarterback generally touches a football. The shaded areas 160 designate where the football is supposed to touch a quarterbacks throwing hand. Providing an opening on and below the palmar digital crease 161 would therefore provide significant feel opportunities with the standard football grip.

FIG. 8 is a drawing showing the three basic ways a golf club crosses the palm area of a user.

The 'D' line represents what is called a "distance" grip pattern. This grip pattern is often described as a finger grip pattern. As the title suggests, this grip is maintained on and just below the fingers.

The 'N' line represents what is called a "neutral grip" pattern. It is also called a low palmar grip pattern, because the grip lies across the low palm, and it is below the hypothenar eminence (heel pad) 141.

The 'C' line represents what is called a "control" grip pattern. It is also referred to as a mid-palmar grip pattern, because it runs across the middle of the left palm, and it lies across/over the hypothenar eminence (heel pad) 141.

FIG. 9 is a drawing of a typical way of gripping a golf putter. It shows how providing a glove with a strategically placed opening on the palm would allow a golfer to be able to feel the putter and not have to therefore remove the glove.

FIG. 10 is the dorsal (back) view of embodiment 1, and the palmar view of the same embodiment is shown in FIG. 1. This partial-fingered embodiment provides a glove having a dorsal portion 8, a palmar portion 7 for overlaying respective back and palm regions of a human hand, said dorsal and palmar portions having distal and proximal ends with a plurality of digital segments (or stalls) projecting from said distal ends. Additionally, two separate openings or ringlets 18, 19 are provided on said distal ends, such that a user's ring finger 16 and pinkie finger 12 may individually extend through said glove and expose the entire ring finger and pinkie finger when the glove is worn. The glove includes a glove body having a back portion covering the back of the hand 8, and a front portion covering substantially all of the palm or front of the hand 7. The glove body includes a forefinger stall 10 and a thumb stall 9 each adapted to receive a forefinger or thumb, respectively, therein. In the illustrated embodiment, the glove is constructed such that the thumb digital segment 9, the forefinger digital segment 10 and the middle finger digital segment 11 enclose the user's thumb, forefinger and middle finger in their entirety, including enclosing the fingertips. The glove does not comprise of finger stalls for a user's ring finger or pinkie finger. The distal ends of the dorsal portion 8 and palmar portion 7 of the glove body further provides two separate finger openings (or ringlets) 17, 18, where the user's ring finger and pinkie finger may extend through said glove body and thereby being completely uncovered by said glove body.

Therefore, the ring finger and pinkie fingers are both all completely uncovered when the glove is worn. In other words, the distal, middle and proximal phalanges of the user's ring and pinkie fingers are completely exposed.

FIG. 11 is the dorsal (back) view of embodiment 2, and the palmar view of the same embodiment is shown in FIG. 2. This partial-fingered embodiment provides a glove having a dorsal portion 25, a palmar portion 24 for overlaying respective back and palm regions of a human hand, said dorsal and palmar portions having distal and proximal ends with a plurality of digital segments (or stalls) projecting from said distal ends. The glove includes a glove body having a back portion covering the back of the hand 25, and a front portion covering substantially all of the palm or front of the hand 24. The glove body includes a thumb stall and a forefinger stall each adapted to receive a thumb 120 and forefinger 128, respectively, therein. In the illustrated embodiment, the glove is constructed such that the glove thumb digital segment and forefinger digital segment enclose the user's thumb 120 and forefinger 128 in their entirety, including enclosing the fingertips. In addition, the glove is also constructed such that the glove middle finger, Ring finger and the Pinkie Finger digital segments 21 are adapted to each partially cover the respective finger of the user's hand, about one-third the way up the fingers, to about the first knuckle. In other words, the middle finger digital segment, the ring finger digital segment and the pinkie finger digital segment each extend to cover the user's proximal phalanx of the user's middle finger, ring finger and pinkie finger when the glove is worn. Therefore, the distal and middle phalanges of the user's middle finger 121 is uncovered, the distal and middle phalanges of the user's ring finger 122 is uncovered, and the distal and middle phalanges of the user's pinkie finger 126 is uncovered when the glove is worn.

FIG. 12 is the dorsal (back) view of embodiment 3, and the palmar view of the same embodiment is shown in FIG. 3. This partial-fingered embodiment provides a glove having a dorsal portion 38, a palmar portion 37 for overlaying respective back and palm regions of a human hand, In the illustrated embodiment, the glove is constructed such that the user's forefinger is uncovered 135, the user's middle finger is uncovered 136, the user's ring finger is uncovered 137 and the user's pinkie finger is uncovered 138 when the glove is worn. In addition, this embodiment provides a grip enhancer along the top portion of the palm area.

More specifically, for example, the grip-enhancing means of this embodiment is adapted to overlay the metacarpophalangeal joints of the user's forefinger, middle finger, ring finger and pinkie finger 231 when the glove is worn. The textured grip-enhancing means does not extend beyond said metacarpophalangeal joints thereby leaving the rest of the palm free of said grip enhancing means. The grip enhancing means may comprise of a plurality of projections 236, such as PVC dots for example. Providing a grip enhancing means along this portion of the palm will significantly enhance grip capabilities for the user, and leaving the rest of the palm portion free of the grip enhancing means will allow the rest of the palm to more easily flex and stretch by not being burdened by the added texturing.

As aforementioned, the glove has one discreet opening, and this one opening is adapted to extend substantially in a middle of the palmar portion of the glove and is substantially in the middle of the glove palmar portion, positioned such that it exposes the middle of the user's palm when the glove is worn. The one opening follows the edge of the thumb bulge 130 but not on it 32. It is extremely important that the one palm opening is positioned to expose substantially only the middle of the user's palm and of a size such that it enables the skin of the user's palm to touch a basketball when the glove is worn, while simultaneously provided added grip along the thumb bulge by covering it.

As aforementioned in the specification, a critical benefit here is the ability to quickly assess her shot and therefore being able to adjust accordingly by only exposing the shooter's gap area of the user's hand. The benefits of this glove include the ability to enhance the senses around the uncovered palm (relative to the other parts of the hand which are covered) so that the basketball player could more easily know when the basketball is touching the palm, generally indicating bad shooting form. The palm opening can vary in size and shape as long as it doesn't extend significantly beyond substantially the middle of the palm area. Having multiple openings or a much wider opening could diminish tactile sensitivities along the shooter's gap area, a principal objective and advantage of the present invention.

I claim:

1. A basketball glove comprising: a partial palmless glove, said partial palmless glove having a palmar portion that is adapted to overlay a palm of a user's hand, said glove having one opening extending in a middle of the palmar portion of the glove and is adapted to expose a user's palm to touch a basketball when the glove is worn;

wherein said one opening is the only opening along the glove palmar portion;

wherein said one opening has a diamond shape having an upper first edge, an upper second edge, a lower first edge and a lower second edge;

said lower second edge adapted to abut but not expose a thumb bulge of the user's palm;

wherein said one opening upper first edge and said upper second edge are adapted to not expose any portion of a palmar digital crease area of the user's hand.

2. The basketball glove as claimed in claim 1, wherein said glove is absent of any digital segments thereby completely exposing a thumb, forefinger, middle finger, ring finger and pinkie finger of the wearer's hand when the glove is worn.

3. The basketball glove as claimed in claim 1, wherein said glove palmar portion comprises of a grip enhancing means that is adapted to overlay a metacarpophalangeal joint of the user's forefinger, a metacarpophalangeal joint of the user's ring finger, and a metacarpophalangeal joint of the user's pinkie finger when the glove is worn; and, wherein said grip enhancing means is configured to create a higher coefficient of friction than a surrounding glove body material forming the glove body palmar portion.

4. The basketball glove as claimed in claim 1, wherein said glove further comprises of a dorsal portion that is adapted to overlay a back of the user's hand, said glove dorsal and palmar portions each having distal and proximal ends;

wherein said basketball glove having distal ends such that the user's thumb, forefinger, middle finger, ring finger and pinkie finger are each exposed and uncovered by the glove; and, wherein said glove body palmar and dorsal portions each having a hypothenar eminence section that is adapted to overlay a hypothenar eminence of the user's hand when the glove is worn.

5. The basketball glove as claimed in claim 1, wherein said glove further comprises a grip-enhancing means that is positioned along a top portion of the glove palmar portion and is adapted to increase grip along said top portion, thereby allowing the user to better control a basketball when the glove is worn by increasing grip along said top portion as compared to the surrounding palmar portion;

said grip enhancing means comprising of a plurality of projections configured to create a higher coefficient than a surrounding glove body material forming the glove palmar portion.

6. The basketball glove as claimed in claim 1, wherein said glove palmar portion has a thumb bulge portion that is configured to overlay a thumb bulge of the user's hand.

7. The basketball glove as claimed in claim 1, wherein said one opening is the only opening on the glove palmar portion overlaying the user's palm; and wherein said palmar portion further comprises a grip enhancing means consisting of a plurality of depressions.

8. The basketball glove as claimed in claim 1, wherein said glove palmar portion has a top portion;

said top portion comprising of a grip-enhancing means that is configured to create a higher coefficient of friction than a surrounding glove palmar portion, thereby increasing the grip capabilities of the user along said palmar top portion when the glove is worn; and, wherein said basketball glove further comprises a glove body having a dorsal portion adapted to overlay a back of the user's hand;

said glove dorsal and palmar portions comprising distal and proximal ends with a plurality of digital segments projecting from said distal ends, wherein the proximal ends of the glove dorsal and palmar portions collectively define a glove body proximal end, and the distal ends of the glove dorsal and palmar portions collectively define a glove body distal end;

wherein said basketball glove distal ends are adapted to expose and uncover the user's thumb, forefinger, middle finger, ring finger and pinkie finger when the glove is worn.

9. The basketball glove as claimed in claim 1, wherein said glove palmar portion has a top portion;

said top portion comprising of a grip-enhancing means that is adapted to create a higher coefficient of friction than a surrounding glove palmar portion, thereby increasing the grip capabilities of the user along said palmar top portion when the glove is worn;

wherein said grip-enhancing means consists of PVC dots.

10. The basketball glove as claimed in claim 1, wherein said one opening is positioned such that said diamond shape opening is widest in a middle of the opening and is narrowest at a north and a south endpoint.

11. A sports glove to assist a user to shoot a basketball properly, comprising a partial palmless glove, said partial palmless glove having a palmar portion for overlaying an entire palm of the user's hand, said glove having one opening extending across a middle area of the palm of the user's hand and adapted to extend in said middle area of the palmar portion of the glove thereby exposing the entire middle of the user's palm;

said palm one opening having a size to expose a user's palm to touch the basketball when the glove is worn;

wherein said one opening is the only opening along the glove palmar portion of substantial size to enable the skin of the user's exposed palm to touch the basketball;

wherein said one opening has a diamond shape with a upper first edge, a upper second edge, a lower first edge and a lower second edge;

said lower second edge is adapted to abut but not expose a thumb bulge of the user's palm;

wherein said one opening upper first edge and said upper second edge do not expose any portion of a palmar digital crease area of the user's hand when the glove is worn; and, wherein said glove palmar portion is adapted to overlay a thumb metacarpophalangeal joint, a forefinger metacarpophalangeal joint, a ring finger metacarpophalangeal joint, and a pinkie finger metacarpophalangeal joint when the glove is worn;

wherein said one opening is positioned along the palmar portion such that said opening extends to leave exposed only a shooter's gap region of the user's palm, and thereby allowing the user to focus attention on maintaining the shooter's gap region from touching the basketball while shooting the basketball, and providing instant feedback if said shooter's gap is breached by the basketball touching an exposed palm portion when the glove is worn.

12. The sports glove as claimed in claim 11, wherein said glove palmar top portion comprises of a grip-enhancing means that creates a higher coefficient of friction than a surrounding glove palmar portion, thereby increasing the grip capabilities of the user along said palmar top portion when the glove is worn;

wherein said grip enhancing means does not extend beyond said glove palmar top portion such that the remaining palmar portion is free of said grip enhancing means.

13. The sports glove as claimed in claim 11, wherein said glove having open distal ends adapted to entirely expose and uncover the user's thumb, forefinger, middle finger, and ring finger are each entirely exposed and uncovered by the glove when the glove is worn.

14. The sports glove as claimed in claim 11, wherein said basketball glove palmar top portion further comprises of a grip-enhancing means;

wherein said grip-enhancing means is adapted to increase a grip along metacarpophalangeal joints of the user's palm when gripping a basketball with the shooting hand using a preferred shooting grip;

wherein said grip enhancing means is adapted to create a higher coefficient of friction than a surrounding glove palmar portion material.

15. The use of the sports glove as claimed in claim 11 in the sport of basketball.

16. The sports glove as claimed in claim 11, wherein said one opening is on the middle area of the palm area of the glove; and wherein said one opening second lower edge follows a thumb bulge crease of the user's hand when the glove is worn; and wherein said sports glove has open distal ends such that the user's thumb, ring finger, forefinger, middle finger, and pinkie finger are each exposed by the glove when the glove is worn; and glove palmar top portion comprises of a grip-enhancing means consisting of a plurality of projections;

plurality of projections being configured to create a higher coefficient of friction than a surrounding glove palmar portion, thereby increasing the grip capabilities of the user along said palmar portion when the glove is worn;

wherein said grip enhancing means does not extend beyond said glove palmar top portion such that the remaining palmar portion is free of said grip enhancing means;

wherein said opening extends to leave exposed only the middle of the user's palm defining a basketball shooter's gap region, and thereby allowing a user to focus attention on maintaining a shooter's gap region while shooting the basketball, and providing immediate feedback if the shooter's gap region is breached by allowing said basketball to touch the exposed shooter's gap region of the user's palm when the glove is worn.

* * * * *